US008763674B2

(12) United States Patent
Kataoka et al.

(10) Patent No.: US 8,763,674 B2
(45) Date of Patent: Jul. 1, 2014

(54) SOLAR RADIATION SHIELDING APPARATUS

(75) Inventors: Kouichi Kataoka, Tokyo (JP); Shin Imai, Tokyo (JP); Shunsuke Suzuki, Tokyo (JP)

(73) Assignee: Toso Company, Limited, Tokyo (JP)

( * ) Notice: Subject to any disclaimer, the term of this patent is extended or adjusted under 35 U.S.C. 154(b) by 44 days.

(21) Appl. No.: 13/519,147

(22) PCT Filed: Jan. 19, 2011

(86) PCT No.: PCT/JP2011/050820

§ 371 (c)(1),
(2), (4) Date: Jun. 26, 2012

(87) PCT Pub. No.: WO2011/090051

PCT Pub. Date: Jul. 28, 2011

(65) Prior Publication Data

US 2012/0285632 A1 Nov. 15, 2012

(30) Foreign Application Priority Data

Jan. 25, 2010 (JP) ..... 2010-012975
Sep. 28, 2010 (JP) ..... 2010-216590

(51) Int. Cl.
*E06B 9/08* (2006.01)

(52) U.S. Cl.
USPC ..... 160/120; 160/291

(58) Field of Classification Search
USPC ..... 160/120, 319, 320, 300, 291, 297
See application file for complete search history.

(56) References Cited

U.S. PATENT DOCUMENTS 4,418,739 A * 12/1983 Woolnough et al. ..... 160/120
5,392,549 A 2/1995 Castro
5,538,065 A 7/1996 Geraud (Continued)

FOREIGN PATENT DOCUMENTS

CN 101213349 7/2008
JP 02-232492 9/1990

(Continued)

OTHER PUBLICATIONS

Korea Office action, dated Jul. 16, 2013 along with an english translation thereof.

(Continued)

*Primary Examiner* — Katherine Mitchell
*Assistant Examiner* — Johnnie A Shablack
(74) *Attorney, Agent, or Firm* — Greenblum & Bernstein P.L.C.

(57) ABSTRACT

First and second lifting and lowering units are connected to first and second shielding members hung from a head rail, and an operating cord drives the units to lift and lower the shielding members independently. An operating cord is wound around a rotating member. Between a first input shaft to which the turning force of the rotating member is transferred and a first output shaft that can lift and lower the first shielding member, a first clutch of the first lifting and lowering unit is provided, and a first stopper is provided in the first output shaft. Between a second input shaft to which the turning force of the rotating member is transferred and a second output shaft that can lift and lower the second shielding member, a second clutch of the second lifting and lowering unit is provided, and a second stopper is provided in the second output shaft.

7 Claims, 11 Drawing Sheets

(56) References Cited

U.S. PATENT DOCUMENTS

| | | | | |
|---|---|---|---|---|
| 7,849,907 | B2 * | 12/2010 | Jang | 160/86 |
| 8,025,088 | B2 * | 9/2011 | Kim | 160/120 |
| 2008/0190569 | A1 * | 8/2008 | Jang | 160/127 |
| 2011/0061821 | A1 * | 3/2011 | Kim | 160/305 |
| 2012/0291965 | A1 * | 11/2012 | Marocco | 160/120 |
| 2013/0098563 | A1 * | 4/2013 | Jang | 160/120 |
| 2013/0098564 | A1 * | 4/2013 | Jang | 160/120 |

FOREIGN PATENT DOCUMENTS

| | | |
|---|---|---|
| JP | 10-176471 | 6/1998 |
| JP | 4119692 | 5/2008 |
| JP | 2008-231913 | 10/2008 |
| WO | 94/12756 | 6/1994 |
| WO | 2007/004852 | 1/2007 |

OTHER PUBLICATIONS

International Preliminary Report on Patentability and English Language Translation, Aug. 9, 2012.

International Search Report, May 10, 2011.

Taiwan Office action, dated May 23, 2013 along with an english translation thereof.

Australian Official Action, mail date is Nov. 4, 2013.

* cited by examiner

SOLAR RADIATION SHIELDING APPARATUS

TECHNICAL FIELD

The present invention relates to a solar radiation shielding apparatus that lifts and lowers two shielding members, each being hung from a head rail, with operation of a single operating cord.

BACKGROUND ART

In the past, as this type of solar radiation shielding apparatus, a solar radiation member lifting and lowering apparatus that supports first and second solar radiation shielding members suspended from a head box and can lift and lower the first and second solar radiation shielding members independently by effecting the operation of first and second lifting and lowering operation sections with operation of one endless operating cord hung from the head box has been disclosed (see, for example, Patent Document 1). The solar radiation member lifting and lowering apparatus includes first and second stopper units that allow a state in which the solar radiation shielding members are not lowered as a result of the first and second solar radiation shielding members being prevented from being lowered under the own weights thereof or a state in which the solar radiation shielding members are lowered as a result of the first and second solar radiation shielding members being allowed to be lowered under the own weights thereof to be selected, a first clutch unit that allows a lifting operation of the first solar radiation shielding member and a lowering operation thereof due to the own weight thereof by making the first lifting and lowering operation section and the first stopper unit operate with operation of the operating cord to one side without lifting or lowering the second solar radiation shielding member or an operation to prevent the falling of the first solar radiation shielding member due to the own weight thereof to stop the falling of the first solar radiation shielding member due to the own weight thereof to be selected, and a second clutch unit that allows a lifting operation of the second solar radiation shielding member and a lowering operation thereof due to the own weight thereof by making the second lifting and lowering operation section and the second stopper unit operate with operation of the operating cord to the other side without lifting or lowering the first solar radiation shielding member and an operation to prevent the falling of the second solar radiation shielding member due to the own weight thereof to stop the falling of the second solar radiation shielding member due to the own weight thereof to be selected.

The first clutch unit is formed of a first rotating drum that is rotated based on the operation of the operating cord, a first transfer drum driving the first lifting and lowering operation section, and a first clutch section transferring the rotation of the first rotating drum to the first transfer drum. The first clutch section is configured such that the turning force of the first rotating drum based on the operation of the operating cord to one side can be transferred to the first transfer drum and the first transfer drum is freely rotatable independently of the first rotating drum when the first transfer drum is rotated based on the falling of the first solar radiation shielding member due to the own weight thereof. Moreover, the second clutch unit is formed of a second rotating drum that is rotated based on the operation of the operating cord, a second transfer drum driving the second lifting and lowering operation section, and a second clutch section transferring the rotation of the second rotating drum to the second transfer drum. The second clutch section is configured such that the turning force of the second rotating drum based on the operation of the operating cord to the other side can be transferred to the second transfer drum and the second transfer drum is freely rotatable independently of the second rotating drum when the second transfer drum is rotated based on the falling of the second solar radiation shielding member due to the own weight thereof.

Furthermore, the first and second clutch sections are each formed of a clutch drum rotatably supported on a shaft, a guide groove formed on the outer periphery of the clutch drum, a clutch ball that moves along the guide groove, and a stop spring that prevents the rotation of the clutch drum based on the turning force exerted from the clutch drum and integrally rotates the first or second rotating drum and the clutch drum based on the turning force exerted from the first or second rotating drum. The above-described guide groove is formed of an engagement groove that makes it possible to transfer the turning force of the first or second rotating drum to the first or second transfer drum via the clutch ball and a release groove leading out of the engagement groove in such a way as to be offset to the side where the first or second rotating drum is located, the release groove allowing the first or second transfer drum to rotate freely with respect to the first or second rotating drum. Moreover, when the turning force of the first rotating drum is transferred to the first transfer drum via the clutch ball, the turning force of the second rotating drum is not transferred to the second transfer drum; when the turning force of the second rotating drum is transferred to the second transfer drum via the clutch ball, the turning force of the first rotating drum is not transferred to the first transfer drum. In the solar radiation member lifting and lowering apparatus structured as described above, by making it possible to lift and lower the two solar radiation shielding members independently with one operating cord and automatically perform lifting or lowering operation of each solar radiation shielding member with one-touch operation of the operating cord, the solar radiation shielding members can be lifted and lowered easily.

Patent Document 1: Japanese Patent No. 4119692 (claim 1, paragraphs [0043] and [0157])

DISCLOSURE OF INVENTION

Problem to be Solved by the Invention

However, in the solar radiation member lifting and lowering apparatus disclosed in Patent Document 1 described above, the component elements such as the clutch ball and the stop spring are used and the guide groove formed of the engagement groove and the release groove is formed in the clutch drum, which makes the structure of the clutch unit complicated. Moreover, in the solar radiation member lifting and lowering apparatus disclosed in Patent Document 1 described above, since the first or second clutch drum moves with the clutch ball along the guide groove in an axial direction of a first or second shaft, the entire lengths of the first and second clutch units are increased accordingly.

A first object of the present invention is to provide a solar radiation shielding apparatus that can lift and lower a first shielding member and a second shielding member independently with a relatively simple structure with operation of one operating cord. A second object of the present invention is to provide a solar radiation shielding apparatus that can reduce the entire lengths of first and second clutches by performing switching by the first and second clutches with radial revolution and reciprocating movement of first and second input shafts.

Means for Solving Problem

According to a first aspect of the present invention, as shown in FIGS. 1, 6, and 7, in a solar radiation shielding apparatus including: a head rail 13; first and second shielding members 11 and 12 hung from the head rail 13; a first lifting and lowering unit 21 provided in the head rail 13 and connected to the first shielding member 11; a second lifting and lowering unit 22 provided in the head rail 13 and connected to the second shielding member 12; and a single operating cord 14 coupled to the first and second lifting and lowering units 21 and 22, the operating cord 14 lifting and lowering the first and second shielding members 11 and 12 independently by driving the first and second lifting and lowering units 21 and 22, a rotating member 26 is rotatably attached to the head rail 13, the operating cord 14 is wound around the rotating member 26, the first lifting and lowering unit 21 has a first input shaft 21*a* rotatably attached to the head rail 13, the first input shaft 21*a* to which a turning force of the rotating member 26 is transferred without a turning force transfer mechanism 50 or via the turning force transfer mechanism 50, a first output shaft 21*b* rotatably attached to the head rail 13 coaxially with the first input shaft 21*a*, the first output shaft 21*b* that can lift and lower the first shielding member 11, a first clutch 31 provided between the first input shaft 21*a* and the first output shaft 21*b*, the first clutch 31 transferring a turning force from the rotating member 26, the turning force in one direction, to the first output shaft 21*b* via the first input shaft 21*a*, the first clutch 31 that does not transfer a turning force from the rotating member 26, the turning force in the other direction, to the first output shaft 21*b* and does not transfer a turning force from the first output shaft 21*b* to the first input shaft 21*a*, and a first stopper provided in the first output shaft 21*b*, the first stopper switching the first shielding member 11 to a falling state or a stopped state with slight operation of the operating cord 14 in one direction, and the second lifting and lowering unit 22 has a second input shaft 22*a* rotatably attached to the head rail 13, the second input shaft 22*a* to which a turning force of the rotating member 26 is transferred via a turning force transfer mechanism 50 or without the turning force transfer mechanism 50, a second output shaft 22*b* rotatably attached to the head rail 13 coaxially with the second input shaft 22*a*, the second output shaft 22*b* that can lift and lower the second shielding member 12, a second clutch 32 provided between the second input shaft 22*a* and the second output shaft 22*b*, the second clutch 32 transferring a turning force from the rotating member 26, the turning force in the other direction, to the second output shaft 22*b* via the second input shaft 22*a*, the second clutch 32 that does not transfer a turning force from the rotating member 26, the turning force in one direction, to the second output shaft 22*b* and does not transfer a turning force from the second output shaft 22*b* to the second input shaft 22*a*, and a second stopper 42 provided in the second output shaft 22*b*, the second stopper 42 switching the second shielding member 12 to a falling state or a stopped state with slight operation of the operating cord 14 in the other direction.

A second aspect of the present invention is an invention based on the first aspect, and, as shown in FIGS. 1 and 2, the first clutch 31 has a first engaging section 31*b* revolvable or reciprocatable in a radial direction of the first input shaft 21*a*, and the first clutch 31 transfers the turning force from the rotating member 26, the turning force in one direction, to the first output shaft 21*b* via the first input shaft 21*a* by the first engaging section 31*b* and does not transfer the turning force from the rotating member 26, the turning force in the other direction, to the first output shaft 21*a* and the turning force from the first output shaft 21*b* to the first input shaft 21*a*, and the second clutch has a second engaging section 32*b* revolvable or reciprocatable in a radial direction of the second input shaft 22*a*, and the second clutch 32 transfers the turning force from the rotating member 26, the turning force in the other direction, to the second output shaft 22*b* via the second input shaft 22*a* by the second engaging section 32*b* and does not transfer the turning force from the rotating member 26, the turning force in one direction, to the second output shaft 22*b* and the turning force from the second output shaft 22*b* to the second input shaft 22*a*.

A third aspect of the present invention is an invention based on the second aspect, and, as shown in FIGS. 1 and 2, as a result of the first engaging section 31*b* rotating or moving to the outside in the radial direction of the first input shaft 21*a*, the first output shaft 21*b* engages the first input shaft 21*a* and rotates in synchronization with the first input shaft 21*a*, and, as a result of the first engaging section 31*b* rotating or moving to the inside in the radial direction of the first input shaft 21*a*, the first output shaft 21*b* is moved out of engagement with the first input shaft 21*a* and stops rotating in synchronization with the first input shaft 21*a*, and, as a result of the second engaging section 32*b* rotating or moving to the outside in the radial direction of the second input shaft 22*a*, the second output shaft 22*b* engages the second input shaft 22*a* and rotates in synchronization with the second input shaft 22*a*, and, as a result of the second engaging section 32*b* rotating or moving to the inside in the radial direction of the second input shaft 22*a*, the second output shaft 22*b* is moved out of engagement with the second input shaft 22*a* and stops rotating in synchronization with the second input shaft 22*a*.

A fourth aspect of the present invention is an invention based on the first to third aspects, and, as shown in FIGS. 1 and 2, the first clutch 31 has a first output drum 31*a* attached to the first output shaft 21*b* in such a way that the first output drum 31*a* cannot rotate, the first output drum 31*a* in which a first cylindrical section 31*c* that is loosely fitted over the first input shaft 21*a* is provided, the first cylindrical section 31*c* having an inner circumferential surface in which a first engaged section 31*d* is formed, a first clutch drum 61 rotatably fitted over the first input shaft 21*a* in such a way that the first clutch drum 61 is located inside the first cylindrical section 31*c*, a first cam 71 fitted over the first input shaft 21*a* in such a way that the first cam 71 cannot rotate and is located inside the first cylindrical section 31*c*, the first cam 71 in which a first arm section 71*a* extending to the outside in the radial direction of the first input shaft 21*a* is formed, and the first engaging section 31*b* revolvably attached to a side face of the first clutch drum 61, the first engaging section 31*b* engaging the first engaged section 31*d* by jutting to the outside in the radial direction of the first input shaft 21*a* as a result of the first arm section 71*a* of the first cam 71 engaging the first engaging section 31*b* at the time of rotation of the rotating member 26 in one direction, the first engaging section 31*b* that does not engage the first engaged section 31*d* as a result of retracting to the inside in the radial direction of the first input shaft 21*a* at the time of rotation of the rotating member 26 in the other direction or at the time of rotation of the first output shaft 21*b*, and the second clutch 32 has a second output drum 32*a* attached to the second output shaft 22*b* in such a way that the second output drum 32*a* cannot rotate, the second output drum 32*a* in which a second cylindrical section 32*c* that is loosely fitted over the second input shaft 22*a* is provided, the second cylindrical section 32*c* having an inner circumferential surface in which a second engaged section 32*d* is formed, a second clutch drum 62 rotatably fitted over the second input shaft 22*a* in such a way that the second clutch drum 62 is located inside the second cylindrical section 32*c*, a second cam 72 fitted over the second input shaft 22*a* in such a way that the second cam 72 cannot rotate and is located inside the second cylindrical section 32*c*, the second cam 72 in which a second arm section 72*a* extending to the outside in the radial direction of the second input shaft 22*a* is formed, and the second engaging section 32*b* revolvably attached to a side face of the second clutch drum 62, the second engaging section 32*b* engaging the second engaged section 32*d* by jutting to the outside in the radial direction of the second input shaft 22*a* as a result of the second arm section 72*a* of the second cam 72 engaging the second engaging section 32*b* at the time of rotation of the rotating member 26 in the other direction, the second engaging section 32*b* that does not engage the second engaged section 32*d* as a result of retracting to the inside in the radial direction of the second input shaft 22*a* at the time of rotation of the rotating member 26 in one direction or at the time of rotation of the second output shaft 22*b*.

A fifth aspect of the present invention is an invention based on the fourth aspect, and, as shown in FIGS. 8 to 10, an angle which a flat surface of the first engaged section 131*d*, the flat surface at which the first engaged section 131*d* makes contact with the first engaging section 131*b*, forms with a flat surface making contact with an outer circumferential surface of the first cylindrical section 131*c* in the first engaged section 131*d* is set at an acute angle, and an angle which a flat surface of the second engaged section 132*d*, the flat surface at which the second engaged section 132*d* makes contact with the second engaging section 132*b*, forms with a flat surface making contact with an outer circumferential surface of the second cylindrical section 132*c* in the second engaged section 132*d* is set at an acute angle.

A sixth aspect of the present invention is an invention based on the fourth or fifth aspect, and, as shown in FIGS. 1 and 4, between the first input shaft 21*a* and the first clutch drum 61, a first resistance applying mechanism 81 preventing rotation of the first clutch drum 61 relative to the first input shaft 21*a* is provided, and, between the second input shaft 22*a* and the second clutch drum 62, a second resistance applying mechanism 82 preventing rotation of the second clutch drum 62 relative to the second input shaft 22*a* is provided.

A seventh aspect of the present invention is an invention based on the fourth to sixth aspects, and, as shown in FIGS. 1 and 3, a first return spring mechanism 91 urging the first engaging section 31*b* in such a way that the first engaging section 31*b* retracts to the inside in the radial direction of the first input shaft 21*a* is provided in the first engaging section 31*b*, and a second return spring mechanism 92 urging the second engaging section 32*b* in such a way that the second engaging section 32*b* retracts to the inside in the radial direction of the second input shaft 22*a* is provided in the second engaging section 32*b*.

Effect of the Invention

In the solar radiation shielding apparatus of the first aspect of the present invention, when the operating cord is pulled in one direction, the rotating member rotates in one direction, and, since the turning force of the rotating member in one direction is transferred to the first output shaft via the first input shaft and the first clutch or via the turning force transfer mechanism, the first input shaft, and the first clutch, the first shielding member rises. At this time, although the turning force of the rotating member in one direction is transferred to the second clutch via the turning force transfer mechanism and the second input shaft or via the second input shaft, the second clutch does not transfer the above-described turning force in one direction to the second output shaft. Moreover, when the operating cord is slightly pulled in one direction and released while the first shielding member is in a stopped state by the first stopper, the first stopper switches the first shielding member to a falling state. At this time, although the turning force of the rotating member in one direction is transferred to the second clutch as in the case just described, the second clutch does not transfer the above-described turning force in one direction to the second output shaft. In addition, when the first shielding member falls, although the first output shaft rotates in a direction in which the first shielding member is unreeled, this turning force is not transferred to the first input shaft by the action of the first clutch and therefore is not transferred to the second input shaft. To stop the falling of the first shielding member, the operating cord is pulled in one direction. Furthermore, when the operating cord is slightly pulled in one direction and released while the first shielding member is in a falling state by the first stopper, the first stopper switches the first shielding member to a stopped state. At this time, although the turning force of the rotating member in one direction is transferred to the second clutch as in the case just described, the second clutch does not transfer the above-described turning force in one direction to the second output shaft.

On the other hand, when the operating cord is pulled in the other direction, the rotating member rotates in the other direction, and, since the turning force of the rotating member in the other direction is transferred to the second output shaft via the turning force transfer mechanism, the second input shaft, and the second clutch or via the second input shaft and the second clutch, the second shielding member rises. At this time, although the turning force of the rotating member in the other direction is transferred to the first clutch via the first input shaft or via the turning force transfer mechanism and the first input shaft, the first clutch does not transfer the above-described turning force in the other direction to the first output shaft. Moreover, when the operating cord is slightly pulled in the other direction and released while the second shielding member is in a stopped state by the second stopper, the second stopper switches the second shielding member to a falling state. At this time, although the turning force of the rotating member in the other direction is transferred to the first clutch as in the case just described, the first clutch does not transfer the above-described turning force in the other direction to the first output shaft. In addition, when the second shielding member falls, although the second output shaft rotates in a direction in which the second shielding member is unreeled, this turning force is not transferred to the second input shaft by the action of the second clutch and therefore is not transferred to the first input shaft. To stop the falling of the second shielding member, the operating cord is pulled in the other direction. Furthermore, when the operating cord is slightly pulled in the other direction and released while the second shielding member is in a falling state by the second stopper, the second stopper switches the second shielding member to a stopped state. At this time, although the turning force of the rotating member in the other direction is transferred to the first clutch as in the case just described, the first clutch does not transfer the above-described turning force in the other direction to the first output shaft. As a result, it is possible to lift and lower the first shielding member and the second shielding member independently with a relatively simple structure with operation of one operating cord.

In the solar radiation shielding apparatus of the second and third aspects of the present invention, since switching by the first and second clutches is performed by the revolution and reciprocating movement of the first and second engaging sections in the radial direction of the first and second input shafts, the first and second clutches do not extend in the longitudinal direction of the first and second input shafts. This makes it possible to reduce the entire lengths of the first and second clutches.

In the solar radiation shielding apparatus of the fourth aspect of the present invention, when the first cam rotates with the first input shaft by the rotation of the rotating member in one direction, since the first arm section rotates the first engaging section in such a way that the first engaging section juts to the outside in the radial direction of the first input shaft, the first engaging section engages the first engaged section of the first output drum, and the turning force of the first clutch drum is transferred to the first output drum; when the second cam rotates with the second input shaft by the rotation of the rotating member in the other direction, since the second arm section rotates the second engaging section in such a way that the second engaging section juts to the outside in the radial direction of the second input shaft, the second engaging section engages the second engaged section of the second output drum, and the turning force of the second clutch drum is transferred to the second output drum. As a result, since the first and second clutches do not extend in the longitudinal direction of the first and second input shafts, it is possible to reduce the entire lengths of the first and second clutches. Moreover, since the first output shaft rotates in a direction in which the first shielding member is unreeled due to the weight of the first shielding member and the first engaging section is retracted to the inside in the radial direction of the first input shaft by the rotation of the first output drum, the above-described turning force of the first output shaft is not transferred to the first input shaft. Furthermore, since the second output shaft rotates in a direction in which the second shielding member is unreeled due to the weight of the second shielding member and the second engaging section is retracted to the inside in the radial direction of the second input shaft by the rotation of the second output drum, the turning force of the second output shaft is not transferred to the second input shaft. As a result, the first and second shielding members are always lifted and lowered independently.

In the solar radiation shielding apparatus of the fifth aspect of the present invention, since an angle which a flat surface of the first engaged section, the flat surface at which the first engaged section makes contact with the first engaging section, forms with a flat surface making contact with an outer circumferential surface of the first cylindrical section in the first engaged section is set at an acute angle, that is, since vector setting is made so that, when the first cylindrical section rotates in a direction in which the first engaged section is brought into contact with the first engaging section by pressure, the first engaging section escapes in the circumferential direction by using the turning force from the first cylindrical section, the first engaged section rarely bites mechanically the first engaging section and the first engaging section rarely bites mechanically the first arm section. As a result, the first engaging section is promptly removed from the first engaged section. Moreover, since an angle which a flat surface of the second engaged section, the flat surface at which the second engaged section makes contact with the second engaging section, forms with a flat surface making contact with an outer circumferential surface of the second cylindrical section in the second engaged section is set at an acute angle, that is, since vector setting is made so that, when the second cylindrical section rotates in a direction in which the second engaged section is brought into contact with the second engaging section by pressure, the second engaging section escapes in the circumferential direction by using the turning force from the second cylindrical section, the second engaged section rarely bites mechanically the second engaging section and the second engaging section rarely bites mechanically the second arm section. As a result, the second engaging section is promptly removed from the second engaged section.

In the solar radiation shielding apparatus of the sixth aspect of the present invention, since the first resistance applying mechanism preventing rotation of the first clutch drum relative to the first input shaft is provided between the first input shaft and the first clutch drum and the second resistance applying mechanism preventing rotation of the second clutch drum relative to the second input shaft is provided between the second input shaft and the second clutch drum, at the time of initial torque of the first input shaft, the first clutch drum follows the rotation of the first input shaft by the first resistance applying mechanism and, at the time of initial torque of the second input shaft, the second clutch drum follows the rotation of the second input shaft by the second resistance applying mechanism. As a result, the first engaging section attached to the first clutch drum does not accidentally engage the first engaged section of the first output drum, and the second engaging section attached to the second clutch drum does not accidentally engage the second engaged section of the second output drum. This makes it possible to lift and lower the first and second shielding members independently with operation of one operating cord reliably.

In the solar radiation shielding apparatus of the seventh aspect of the present invention, since the first return spring mechanism urging the first engaging section in such a way that the first engaging section retracts to the inside in the radial direction of the first input shaft is provided in the first engaging section and the second return spring mechanism urging the second engaging section in such a way that the second engaging section retracts to the inside in the radial direction of the second input shaft is provided in the second engaging section, even when the first output shaft rotates in a direction in which the first shielding member is unreeled due to the weight of the first shielding member and the first output drum rotates by the rotation of the first output shaft, since the first return spring mechanism maintains a state in which the first engaging section is retracted to the inside in the radial direction of the first input shaft, the turning force of the first output shaft is not transferred to the first input shaft. Moreover, even when the second output shaft rotates in a direction in which the second shielding member is unreeled due to the weight of the second shielding member and the second output drum rotates by the rotation of the second output shaft, since the second return spring mechanism maintains a state in which the second engaging section is retracted to the inside in the radial direction of the second input shaft, the turning force of the second output shaft is not transferred to the second input shaft. As a result, the first and second shielding members can be reliably lifted and lowered independently.

BEST MODES FOR CARRYING OUT THE INVENTION

Next, modes for carrying out the present invention will be described based on the drawings.

<First Embodiment>

Figure 1:
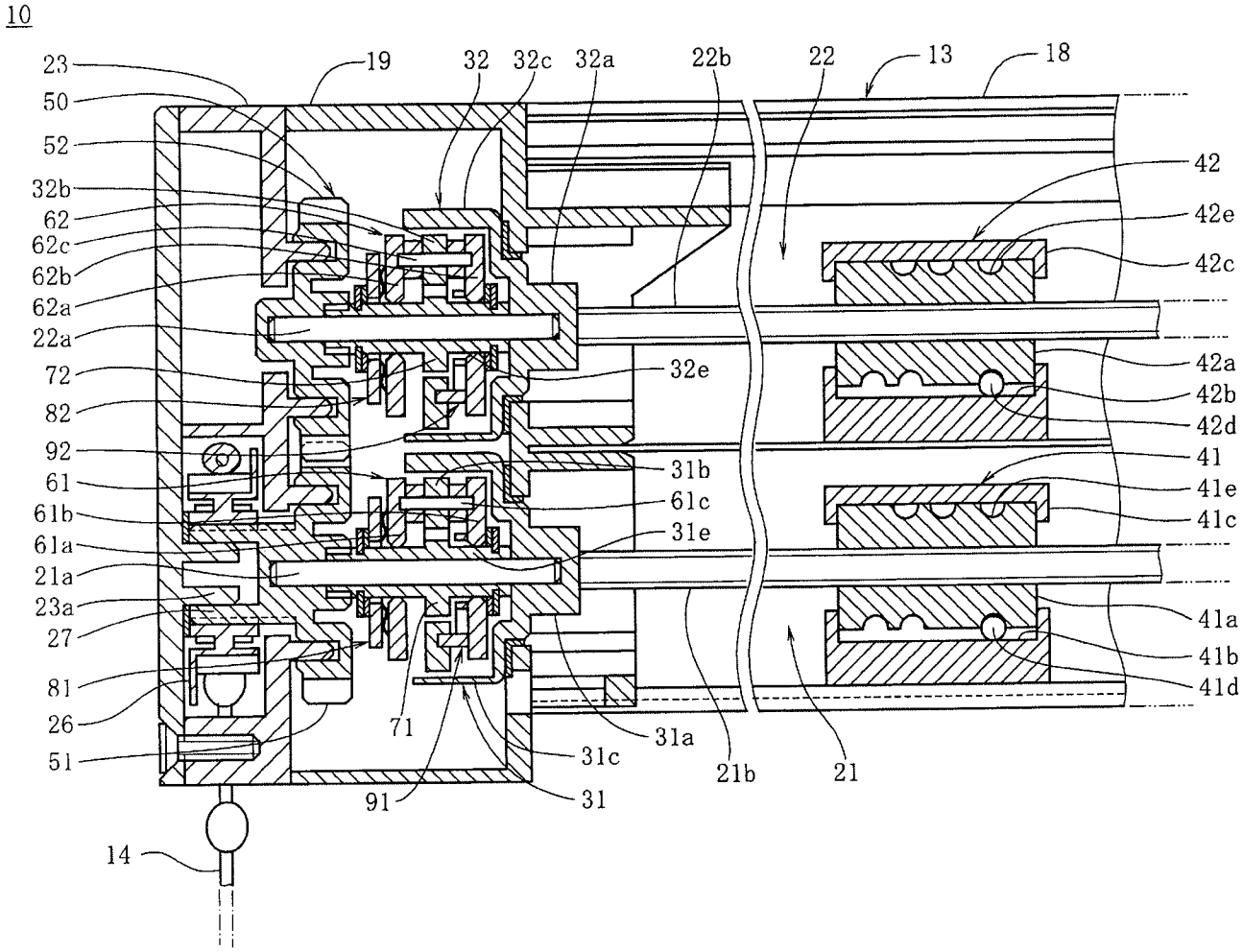
FIG. 1 is an enlarged sectional view of an A portion and a B portion of FIG. 7 showing a roman shade of a first embodiment of the present invention.
Figure 6:
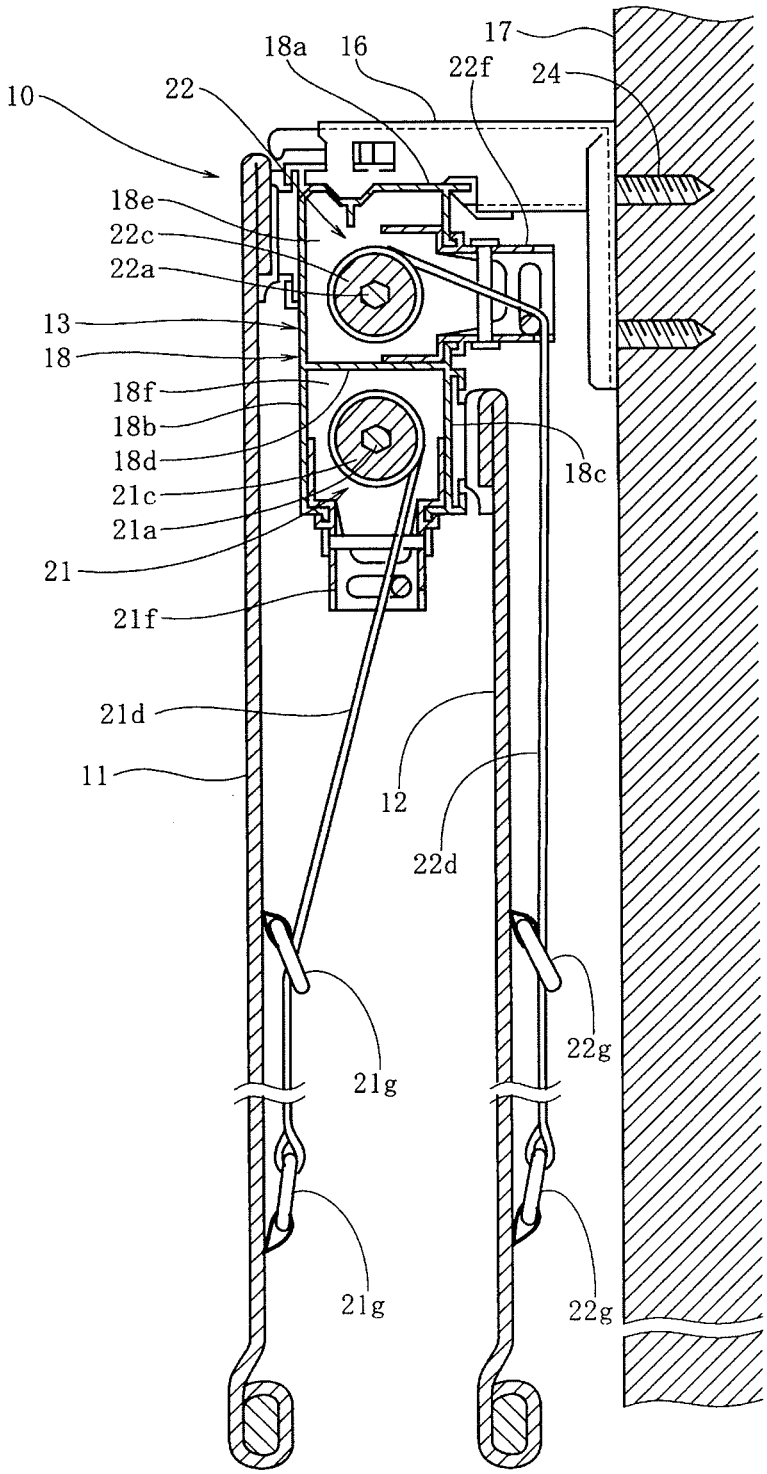
FIG. 6 is a sectional view taken on the line E-E of FIG. 7.
Figure 7:
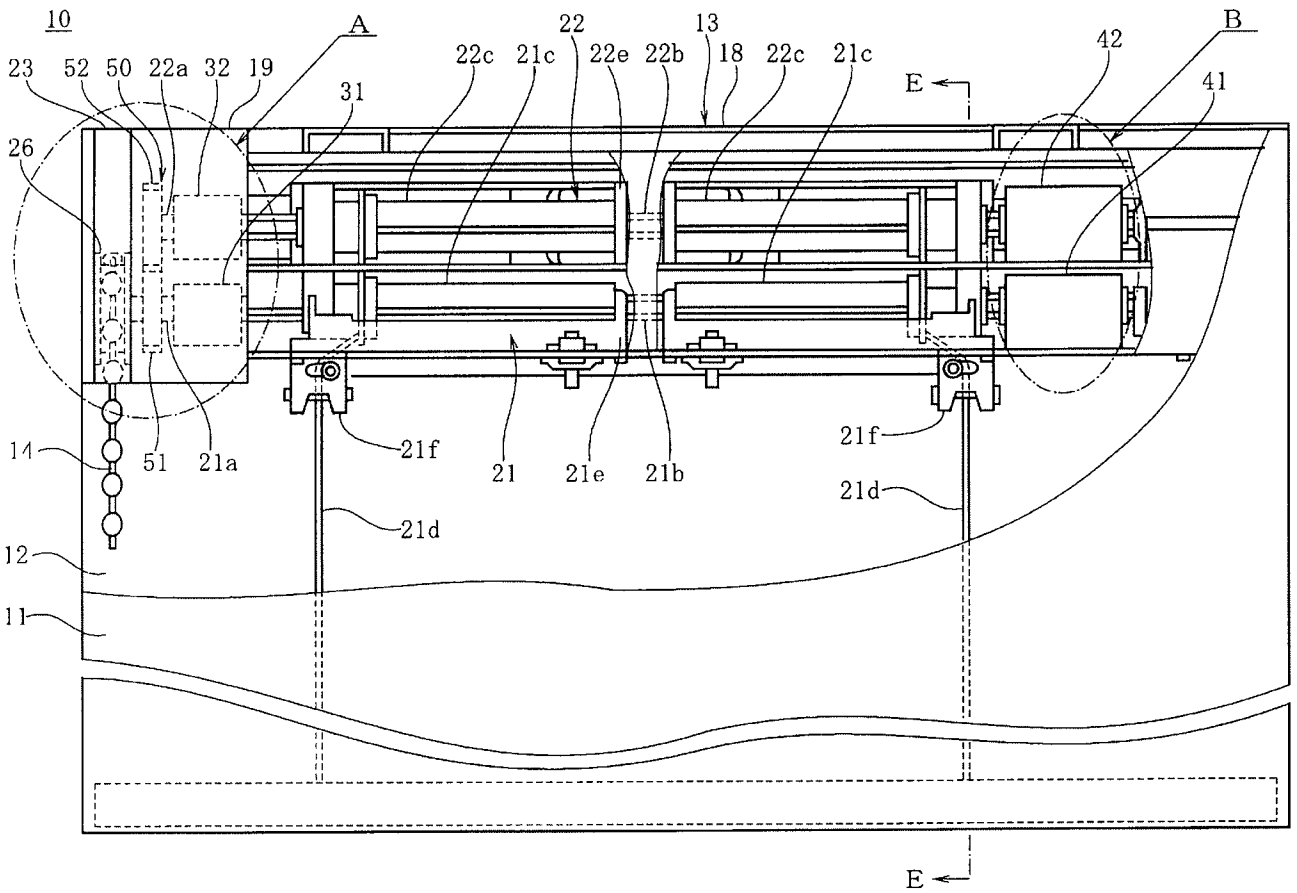
FIG. 7 is a front view of the roman shade, the front view showing a cut-away principal portion.

In this embodiment, a solar radiation shielding apparatus is a roman shade. As shown in FIGS. 6 and 7, a roman shade 10 includes a head rail 13, first and second clothes 11 and 12 hung from the head rail 13, a first lifting and lowering unit 21 that is provided in the head rail 13 and is connected to the first cloth 11, a second lifting and lowering unit 22 that is provided in the head rail 13 and is connected to the second cloth 12, and a single operating cord 14 that is coupled to the first and second lifting and lowering units 21 and 22 and lifts and lowers the first and second clothes 11 and 12 independently by driving the first and second lifting and lowering units 21 and 22. The head rail 13 has a rail main body 18 that is attached to a wall surface 17 (FIG. 6) of a room by means of a fixing bracket 16, a clutch case 19 attached to one end face of the rail main body 18, and a pulley case 23 attached to one end face of the clutch case 19 (FIGS. 1 and 7). The rail main body 18 is formed by extrusion or pultrusion performed on metal such as an aluminum alloy and, as shown in FIG. 6 in detail, has a top portion 18*a*, a front wall 18*b* hung from a front edge of the top portion 18*a*, and a back wall 18*c* hung from a back edge of the top portion 18*a*. A space surrounded with the top portion 18*a*, the front wall 18*b*, and the back wall 18*c* is divided into an upper space 18*e* located on an upper side and a lower space 18*f* located on a lower side by a partition wall 18*d*. Incidentally, reference numeral 24 in FIG. 6 denotes a wood screw for securing the fixing bracket 16 to the wall surface 17.

As shown in FIGS. 1 and 7, in the pulley case 23, a pulley 26 is rotatably housed. Specifically, in the pulley case 23, a boss 23*a* is provided in such a way as to project to the inside of the case 23 toward the lower space 18*f* of the rail main body 18, a drive shaft 27 is rotatably fitted over the boss 23*a*, and the pulley 26 is fitted (spline fitted) to the drive shaft 27 in such a way that relative rotation is impossible. Moreover, around the pulley 26, the above-described ring-shaped (endless) ball chain operating cord 14 is wound. Furthermore, the first and second clothes 11 and 12 have the width that is about the same as the length of the head rail 13. An upper edge of the first cloth 11 is attached to a front face of the head rail 13, that is, an upper part of a front face of the front wall 18*b* of the head rail 13, and an upper edge of the second cloth 12 is attached to a rear face of the head rail 13, that is, a lower part of a rear face of the back wall 18*c* of the head rail 13.

On the other hand, the first lifting and lowering unit 21 has a first input shaft 21*a* rotatably attached to a lower part of the clutch case 19, a first output shaft 21*b* rotatably attached to the head rail 13 coaxially with the first input shaft 21*a*, a first clutch 31 provided between the first input shaft 21*a* and the first output shaft 21*b*, and a first stopper 41 provided on the first output shaft 21*b* (FIG. 1). One end of the above-described first input shaft 21*a* is inserted into the above-described drive shaft 27 in such a way that relative rotation is impossible, and the other end of the first input shaft 21*a* is inserted into a first output drum 31*a*, which will be described later, in such a way that relative rotation is possible. As a result, the first input shaft 21*a* is provided coaxially with the drive shaft 27, and the turning force of the pulley 26 is transferred to the first input shaft 21*a* via the drive shaft 27. Reference numeral 51 in FIGS. 1 and 7 denotes a first gear formed integrally with the drive shaft 27. Moreover, the second lifting and lowering unit 22 has a second input shaft 22*a* rotatably attached to an upper part of the clutch case 19, a second output shaft 22*b* rotatably attached to the head rail 13 coaxially with the second input shaft 22*a*, a second clutch 32 provided between the second input shaft 22*a* and the second output shaft 22*b*, and a second stopper 42 provided on the second output shaft 22*b* (FIG. 1). To the upper part of the clutch case 19, a second gear 52 is rotatably attached, and the second gear 52 engages the first gear 51. One end of the second input shaft 22*a* is inserted into the second gear 52 in such a way that relative rotation is impossible, and the other end of the second input shaft 22*a* is inserted into a second output drum 32*a*, which will be described later, in such a way that relative rotation is possible. As a result, the turning force of the pulley 26 is transferred to the second input shaft 22*a* via the drive shaft 27, the first gear 51, and the second gear 52. The number of teeth of the first gear 51 is equal to the number of teeth of the second gear 52, and the first and second gears 51 and 52 form a turning force transfer mechanism 50. Incidentally, in this embodiment, the pulley is provided on the side where the first input shaft is located. However, the pulley may be provided on the side where the second input shaft is located. In this case, the turning force of the pulley is transferred to the second input shaft without the second gear and the first gear and is transferred to the first input shaft via the second gear and the first gear.

The first output shaft 21*b* is provided in the lower space 18*f* of the rail main body 18 in such a way as to extend in the direction of the length of the lower space 18*f* (FIGS. 1, 6, and 7). To one end of the first output shaft 21*b*, the first output drum 31*a* is attached in such a way that the first output drum 31*a* cannot rotate, and the first output drum 31*a* is rotatably attached to the lower part of the clutch case 19. Moreover, the other end of the first output shaft 21*b* is rotatably attached to the rail main body 18. The first output shaft 21*b* is coupled to the first cloth 11 via a first wind-up drum 21*c* and a first lifting and lowering cord 21*d*. The first wind-up drum 21*c* is fitted over the first output shaft 21*b* in such a way that relative rotation is impossible, and the first lifting and lowering cord 21*d* is wound around the first wind-up drum 21*c* in such a way that the first lifting and lowering cord 21*d* can be unreeled therefrom. Furthermore, the first wind-up drum 21*c* is rotatably held by a first drum support 21*e*, and the first lifting and lowering cord 21*d* wound around the first wind-up drum 21*c* is led out of the lower space 18*f* to a space below the rail main body 18 by a first guide member 21*f* and hung therefrom (FIGS. 6 and 7). Moreover, to a rear face of the first cloth 11, a plurality of first cord rings 21*g* are attached with a predetermined space left between them in a vertical direction. The first lifting and lowering cord 21*d* hung from the lower space 18*f* is placed through the first cord rings 21*g* and routed vertically downward, and then the lower end of the first lifting and lowering cord 21*d* is connected to the first cord ring 21*g* located on the lowermost end of the first cloth 11. As a result of the above-described first output shaft 21*b* rotating to one side or the other side, the first wind-up drum 21*c* rotates in the same direction as the first output shaft 21*b*, the first lifting and lowering cord 21*d* is wound around the first wind-up drum 21*c* or unreeled from the first wind-up drum 21*c*, and the first cloth 11 rises or falls.

On the other hand, the second output shaft 22*b* is provided in the upper space 18*e* of the rail main body 18 in such a way as to extend in the direction of the length of the upper space 18*e* (FIGS. 1, 6, and 7). To one end of the second output shaft 22*b*, the second output drum 32*a* is attached in such a way that the second output drum 32*a* cannot rotate, and the second output drum 32*a* is rotatably attached to the upper part of the clutch case 19. Moreover, the other end of the second output shaft 22*b* is rotatably attached to the rail main body 18. The second output shaft 22*b* is coupled to the second cloth 12 via a second wind-up drum 22*c* and a second lifting and lowering cord 22*d*. The second wind-up drum 22*c* is fitted over the second output shaft 22*b* in such a way that relative rotation is impossible, and the second lifting and lowering cord 22*d* is wound around the second wind-up drum 22*c* in such a way that the second lifting and lowering cord 22*d* can be unreeled therefrom. Furthermore, the second wind-up drum 22*c* is rotatably held by a second drum support 22*e*, and the second lifting and lowering cord 22*d* wound around the second wind-up drum 22*c* is led out of the upper space 18*e* to a space behind the rail main body 18 by a second guide member 22*f* and hung therefrom (FIGS. 6 and 7). Moreover, to a rear face of the second cloth 12, a plurality of second cord rings 22*g* are attached with a predetermined space left between them in a vertical direction. The second lifting and lowering cord 22*d* hung from the upper space 18*e* is placed through the second cord rings 22*g* and routed vertically downward, and then the lower end of the second lifting and lowering cord 22*d* is connected to the second cord ring 22*g* located on the lowermost end of the second cloth 12. As a result of the above-described second output shaft 22*b* rotating to the other side or one side, the second wind-up drum 22*c* rotates in the same direction as the second output shaft 22*b*, the second lifting and lowering cord 22*d* is wound around the second wind-up drum 22*c* or unreeled from the second wind-up drum 22*c*, and the second cloth 12 rises or falls.

Figure 2:
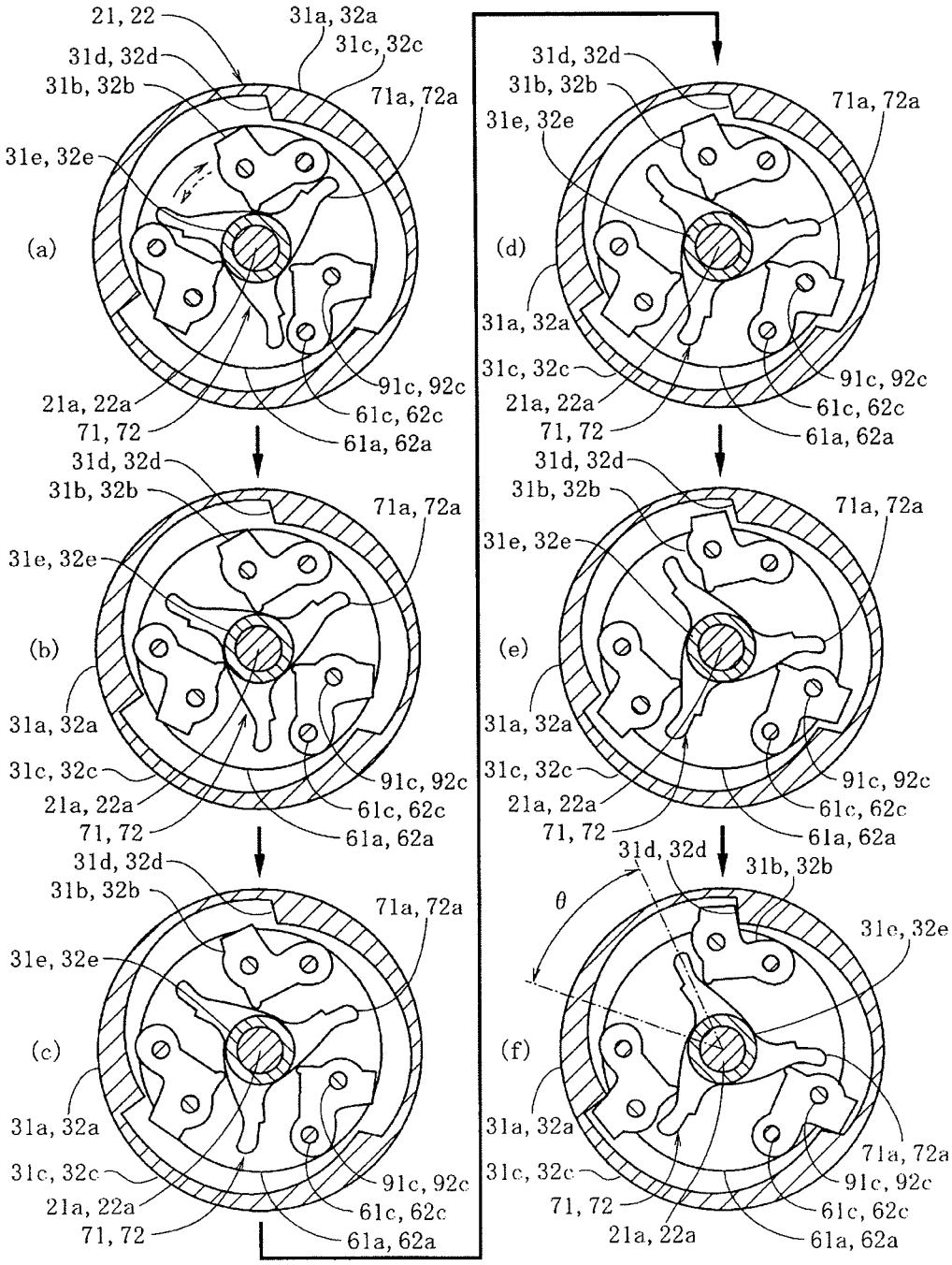
FIG. 2 is a sectional view taken on the line C-C of FIG. 4, the sectional view showing a state in which first and second engaging sections are engaging first and second engaged sections by the rotation of first and second cams.
Figure 4:
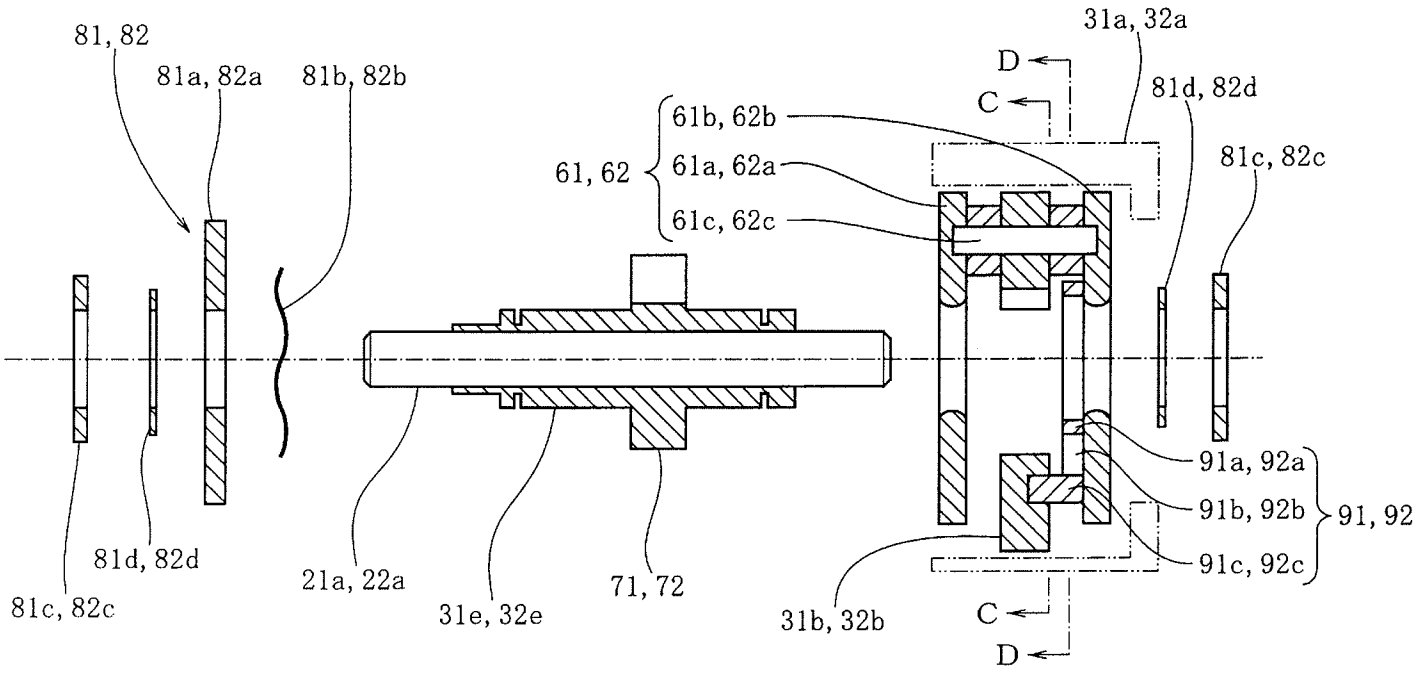
FIG. 4 is an exploded sectional view of first and second clutches.

The first clutch 31 is housed in the lower part of the clutch case 19 (FIG. 1). The first clutch 31 has the above-described first output drum 31*a* attached to the first output shaft 21*b* in such a way that the first output drum 31*a* cannot rotate, a first clutch drum 61 rotatably fitted over the first input shaft 21*a*, a first cam 71 fitted over the first input shaft 21*a* in such a way that the first cam 71 cannot rotate, and first engaging sections 31*b* revolvably attached to the first clutch drum 61 (FIGS. 1, 2, and 4). In the first output drum 31*a*, a large diameter first cylindrical section 31*c* that is loosely fitted over the first input shaft 21*a* is provided, and, in an inner circumferential surface of the first cylindrical section 31*c*, three first engaged sections 31*d* are formed at regular intervals (equiangularly) in a circumferential direction. Moreover, a first cam shaft 31*e* is fitted over the first input shaft 21*a* in such a way that relative rotation is impossible. The first clutch drum 61 is formed of a pair of first disks 61*a* and 61*b*, each having a diameter slightly smaller than the inside diameter of the first cylindrical section 31*c*, and three first supporting shafts 61*c* connecting the first disks 61*a* and 61*b* to each other with a predetermined space left between them.

The pair of first disks 61*a* and 61*b* is loosely inserted into the first cylindrical section 31*c* in a state in which the pair of first disks 61*a* and 61*b* is rotatably fitted over the first cam shaft 31*e*. Moreover, the three first supporting shafts 61*c* are disposed on the same circumference of a circle having a center on the central axis of the first disks 61*a* and 61*b* at regular intervals (equiangularly) in a circumferential direction, and, in this state, both ends of each of the three first supporting shafts 61*c* are attached by insertion to the pair of first disks 61*a* and 61*b*. The above-described first clutch drum 61 is located inside the first cylindrical section 31*c*.

The first cam 71 is formed integrally with the first cam shaft 31*e* (FIGS. 1, 2, and 4). As a result, the first cam 71 cannot rotate with respect to the first input shaft 21*a*. Moreover, the first cam 71 is formed of three first arm sections 71*a* radially extending to the outside in the radial direction of the first input shaft 21*a* in such a way that the three first arm sections 71*a* are located inside the first cylindrical section 31*c*.

Furthermore, the first arm sections 71*a* are each tapered from the base end toward the tip, and the angles, which the first arm sections 71*a* form with the adjacent first arm sections 71*a* are set at the same angle (120 degrees). In this embodiment, three first engaging sections 31*b* are provided, and the first engaging sections 31*b* are each shaped like a letter L. The base ends of the three first engaging sections 31*b* are revolvably fitted over the three first supporting shafts 61*c*. As a result, the three first engaging sections 31*b* are revolvably attached to an inner surface of the first clutch drum 61 in a state in which the three first engaging sections 31*b* are sandwiched between the pair of first disks 61*a* and 61*b*. Moreover, bending outer corner portions of the three first engaging sections 31*b* each face a corresponding one of the base ends of the three first arm sections 71*a*, and the tips of the three first engaging sections 31*b* each face a corresponding one of the three first engaged sections 31*d*. Furthermore, as a result of the first arm sections 71*a* engaging the first engaging sections 31*b* at the time of rotation of the pulley 26 in one direction, the first engaging sections 31*b* rotate about the first supporting shafts 61*c* in one direction, and the tips of the first engaging sections 31*b* jut to the outside in the radial direction of the first input shaft 21*a* and engage the first engaged sections 31*d*; at the time of rotation of the pulley 26 in the other direction or at the time of rotation of the first output shaft 21*b*, the first engaging sections 31*b* rotate about the first supporting shafts 61*c* in the other direction, and the tips of the first engaging sections 31*b* are retracted to the inside in the radial direction of the first input shaft 21*a* and do not engage the first engaged sections 31*d*. That is, as a result of the first engaging sections 31*b* rotating to the outside in the radial direction of the first input shaft 21*a* at the time of rotation of the pulley 26 in one direction, the first output shaft 21*b* engages the first input shaft 21*a* and rotates in synchronization with the first input shaft 21*a;* as a result of the first engaging sections 31*b* rotating to the inside in the radial direction of the first input shaft 21*a* at the time of rotation of the pulley 26 in the other direction or at the time of rotation of the first output shaft 21*b*, the first output shaft 21*b* is moved out of engagement with the first input shaft 21*a* and stops rotating in synchronization with the first input shaft 21*a*. Incidentally, an angle θ at which the first arm sections 71*a* rotate from a state in which the first engaging sections 31*b* are retracted to the innermost positions in the radial direction of the first input shaft 21*a* (FIG. 2(*a*)) to a state in which the first engaging sections 31*b* jut to the outermost positions in the radial direction of the first input shaft 21*a* (FIG. 2(*f*)) is about 50 degrees and is extremely small.

On the other hand, the second clutch 32 has the same structure as the first clutch 31 and is housed in the upper part of the clutch case 19 (FIG. 1). The second clutch 32 has the above-described second output drum 32*a* attached to the second output shaft 22*b* in such a way that the second output drum 32*a* cannot rotate, a second clutch drum 62 rotatably fitted over the second input shaft 22*a*, a second cam 72 fitted over the second input shaft 22*a* in such a way that the second cam 72 cannot rotate, and second engaging sections 32*b* revolvably attached to the second clutch drum 62 (FIGS. 1, 2, and 4). In the second output drum 32*a*, a large diameter second cylindrical section 32*c* that is loosely fitted over the second input shaft 22*a* is provided, and, in an inner circumferential surface of the second cylindrical section 32*c*, three second engaged sections 32*d* are formed at regular intervals (equiangularly) in a circumferential direction. Moreover, a second cam shaft 32*e* is fitted over the second input shaft 22*a* in such a way that relative rotation is impossible. The second clutch drum 62 is formed of a pair of second disks 62*a* and 62*b*, each having a diameter slightly smaller than the inside diameter of the second cylindrical section 32*c*, and three second supporting shafts 62*c* connecting the second disks 62*a* and 62*b* to each other with a predetermined space left between them. The pair of second disks 62*a* and 62*b* is loosely inserted into the second cylindrical section 32*c* in a state in which the pair of second disks 62*a* and 62*b* is rotatably fitted over the second cam shaft 32*e*. Moreover, the three second supporting shafts 62*c* are disposed on the same circumference of a circle having a center on the central axis of the second disks 62*a* and 62*b* at regular intervals (equiangularly) in a circumferential direction, and, in this state, both ends of each of the three second supporting shafts 62*c* are attached by insertion to the pair of second disks 62*a* and 62*b*. The above-described second clutch drum 62 is located inside the second cylindrical section 32*c*.

The second cam 72 is formed integrally with the second cam shaft 32*e* (FIGS. 1, 2, and 4). As a result, the second cam 72 cannot rotate with respect to the second input shaft 22*a*. Moreover, the second cam 72 is formed of three second arm sections 72*a* radially extending to the outside in the radial direction of the second input shaft 22*a* in such a way that the three second arm sections 72*a* are located inside the second cylindrical section 32*c*. Furthermore, the second arm sections 72*a* are each tapered from the base end toward the tip, and the angles, which the second arm sections 72*a* form with the adjacent second arm sections 72*a* are set at the same angle (120 degrees). In this embodiment, three second engaging sections 32*b* are provided, and the second engaging sections 32*b* are each shaped like a letter L. The base ends of the three second engaging sections 32*b* are revolvably fitted over the three second supporting shafts 62*c*. As a result, the three second engaging sections 32*b* are revolvably attached to an inner surface of the second clutch drum 62 in a state in which the three second engaging sections 32*b* are sandwiched between the pair of second disks 62*a* and 62*b*.

Moreover, bending outer corner portions of the three second engaging sections 32*b* each face a corresponding one of the base ends of the three second arm sections 72*a*, and the tips of the three second engaging sections 32*b* each face a corresponding one of the three second engaged sections 32*d*. Furthermore, as a result of the second arm sections 72*a* engaging the second engaging sections 32*b* at the time of rotation of the pulley 26 in the other direction, the second engaging sections 32*b* rotate about the second supporting shafts 62*c* in one direction, and the tips of the second engaging sections 32*b* jut to the outside in the radial direction of the second input shaft 22*a* and engage the second engaged sections 32*d;* at the time of rotation of the pulley 26 in one direction or at the time of rotation of the second output shaft 22*b*, the second engaging sections 32*b* rotate about the second supporting shafts 62*c* in the other direction, and the tips of the second engaging sections 32*b* are retracted to the inside in the radial direction of the second input shaft 22*a* and do not engage the second engaged sections 32*d*. That is, as a result of the second engaging sections 32*b* rotating to the outside in the radial direction of the second input shaft 22*a* at the time of rotation of the pulley 26 in the other direction, the second output shaft 22*b* engages the second input shaft 22*a* and rotates in synchronization with the second input shaft 22*a;* as a result of the second engaging sections 32*b* rotating to the inside in the radial direction of the second input shaft 22*a* at the time of rotation of the pulley 26 in one direction or at the time of rotation of the second output shaft 22*b*, the second output shaft 22*b* is moved out of engagement with the second input shaft 22*a* and stops rotating in synchronization with the second input shaft 22*a*. Incidentally, an angle θ at which the second arm sections 72*a* rotate from a state in which the second engaging sections 32*b* are retracted to the innermost positions in the radial direction of the second input shaft 22*a* (FIG. 2(*a*)) to a state in which the second engaging sections 32*b* jut to the outermost positions in the radial direction of the second input shaft 22*a* (FIG. 2(*f*)) is about 50 degrees and is extremely small.

Figure 3:
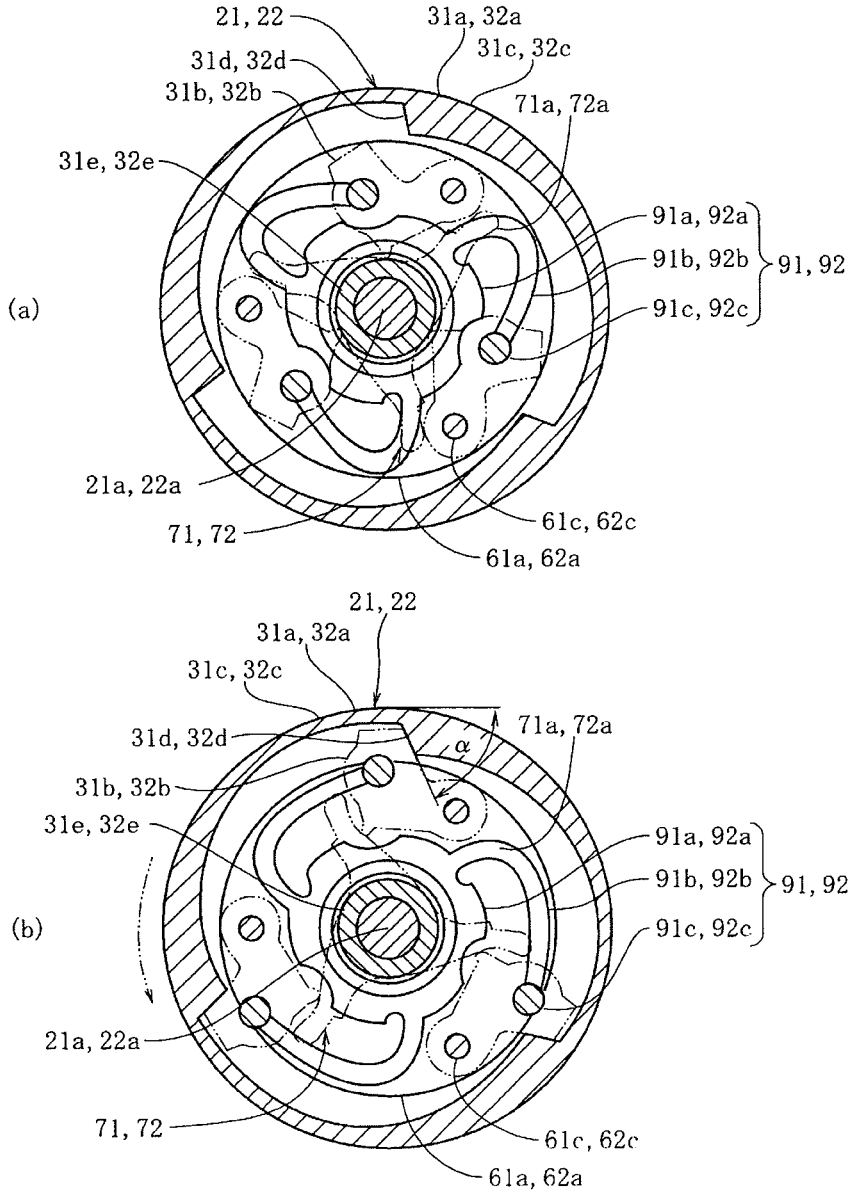
FIG. 3(*a*) is a sectional view taken on the line D-D of FIG. 4, the sectional view showing a state in which the first and second engaging sections are retracted by being rotated to the inside in the radial direction of first and second input shafts by first and second return spring mechanisms, and FIG. 3(*b*) is a sectional view taken on the line D-D of FIG. 4, the sectional view showing a state in which the first and second engaging sections jut by being rotated to the outside in the radial direction of the first and second input shafts by the first and second return spring mechanisms.

On the other hand, as shown in FIG. 3(*b*), an angle α which a flat surface of the first engaged section 31*d*, the flat surface at which the first engaged section 31*d* makes contact with the first engaging section 31*b*, forms with a flat surface making contact with an outer circumferential surface of the first cylindrical section 31*c* in the first engaged section 31*d* is an acute angle (in this embodiment, about 63 degrees), and an angle α which a flat surface of the second engaged section 32*d*, the flat surface at which the second engaged section 32*d* makes contact with the second engaging section 32*b*, forms with a flat surface making contact with an outer circumferential surface of the second cylindrical section 32*c* in the second engaged section 32*d* is an acute angle (in this embodiment, about 63 degrees).

Figure 5:
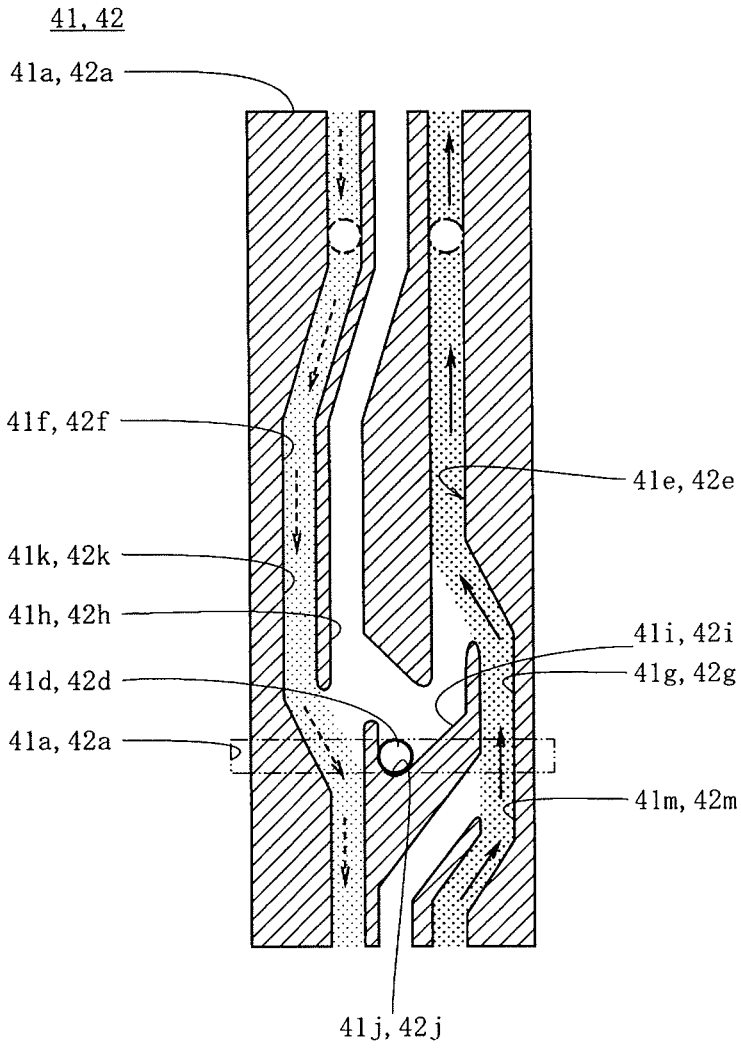
FIG. 5 is a developed view of a first cylindrical cam forming first and second stoppers.

The first stopper 41 switches the first cloth 11 to a falling state or a stopped state with slight operation of the operating cord 14 in one direction (FIGS. 1, 5, and 7). Specifically, the first stopper 41 has a first cylindrical cam 41*a* that is fitted over the first output shaft 21*b* and has a first cam groove 41*e* formed in an outer circumferential surface, a first cam case 41*c* that is attached to the rail main body 18 in such a way as to house the first cylindrical cam 41*a* and has formed therein a first guide groove 41*b* extending in the axial direction of the first output shaft 21*b*, and a first rolling element 41*d* rolling in an overlapping space of the first cam groove 41*e* and the first guide groove 41*b* (FIG. 1). As shown in FIG. 5 in detail, the first cam groove 41*e* has an endless first left edge groove 41*f* formed in a left edge-side outer circumferential surface of the first cylindrical cam 41*a* in such a way as to extend in the circumferential direction of the first cylindrical cam 41*a*, an endless first right edge groove 41*g* formed in a right edge-side outer circumferential surface of the first cylindrical cam 41*a* in such a way as to extend in the circumferential direction of the first cylindrical cam 41*a*, a first coupling groove 41*h* formed between the first left edge groove 41*f* and the first right edge groove 41*g* in such a way as to extend in the circumferential direction of the first cylindrical cam 41*a*, the first coupling groove 41*h* connected, at one end thereof, to the first left edge groove 41*f* and connected, at the other end thereof, to the first right edge groove 41*g*, a first V-shaped groove 41*i* connected, at one end thereof, to the first coupling groove 41*h* and connected, at the other end thereof, to the first right edge groove 41*g* between the first coupling groove 41*h* and the first right edge groove 41*g*, the first V-shaped groove 41*i* formed in roughly the shape of a letter V, and a first recessed portion 41*j* formed in a corner portion located midway in the first V-shaped groove 41*i*.

The above-described first coupling groove 41*h* is formed from the first left edge groove 41*f* to the first right edge groove 41*g* in the form of a left-handed spiral. Moreover, in the first left edge groove 41*f*, a first left curved portion 41*k* curved to the left edge side of the first cylindrical cam 41*a* is formed, and a connection at which the first coupling groove 41*h* is connected to the first left edge groove 41*f* is formed in such a way as to coincide with one end of the first left curved portion 41*k* of the first left edge groove 41*f*. In addition, the first left edge groove 41*f* and the first coupling groove 41*h* are connected in such a way that the first left edge groove 41*f* is nearly aligned with the first coupling groove 41*h*. Moreover, in the first right edge groove 41*g*, a first right curved portion 41*m* curved to the right edge side of the first cylindrical cam 41*a* is formed, and a connection at which the first V-shaped groove 41*i* is connected to the first right edge groove 41*g* is formed in such a way as to coincide with one end of the first right curved portion 41*m* of the first right edge groove 41*g*. In addition, the first right edge groove 41*g* and the first V-shaped groove 41*i* are connected in such a way that the first right edge groove 41*g* is nearly aligned with an end of the first V-shaped groove 41*i*. Moreover, one end of the first V-shaped groove 41*i* is connected to the first coupling groove 41*h* near a connection between the first left edge groove 41*f* and the first coupling groove 41*h*, and the other end of the first V-shaped groove 41*i* is connected to the first right edge groove 41*g* near a connection between the first right edge groove 41*g* and the first coupling groove 41*h*. The first recessed portion 41*j* is formed to have a size that allows the first recessed portion 41*j* to house almost half of the first rolling element 41*d*. The remaining half of the first rolling element 41*d* is housed in the first guide groove 41*b*. Furthermore, the first V-shaped groove 41*i* is formed in the shape of a somewhat deformed letter V so that the first rolling element 41*d* housed in the first recessed portion 41*j* is guided to the first coupling groove 41*h*, not to the first right edge groove 41*g*, by the rotation of the first cylindrical cam 41*a*. As a result, after the first wind-up drum 21*c* is rotated in one direction with slight operation of the operating cord 14 in one direction to lift the first cloth 11 by the first lifting and lowering cord 21*d*, when the hand is disengaged from the operating cord 14, the first stopper 41 stops the rotation of the first wind-up drum 21*c* in a direction in which the first lifting and lowering cord 21*d* is unreeled and the first cloth 11 is lowered, and, after the first wind-up drum 21*c* is rotated again in one direction with slight operation of the operating cord 14 in one direction from this state to lift the first cloth 11 again by the first lifting and lowering cord 21*d*, when the hand is disengaged from the operating cord 14, the first stopper 41 allows the rotation of the first wind-up drum 21*c* in a direction in which the first lifting and lowering cord 21*d* is unreeled and the first cloth 11 is lowered.

On the other hand, the second stopper 42 has the same structure as the first stopper 41 and switches the second cloth 12 to a falling state or a stopped state with slight operation of the operating cord 14 in the other direction (FIGS. 1, 5, and 7). Specifically, the second stopper 42 has a second cylindrical cam 42*a* that is fitted over the second output shaft 22*b* and has a second cam groove 42*e* formed in an outer circumferential surface, a second cam case 42*c* that is attached to the rail main body 18 in such a way as to house the second cylindrical cam 42*a* and has formed therein a second guide groove 42*b* extending in the axial direction of the second output shaft 22*b*, and a second rolling element 42*d* rolling in an overlapping space of the second cam groove 42*e* and the second guide groove 42*b* (FIG. 1). As shown in FIG. 5 in detail, the second cam groove 42*e* has an endless second left edge groove 42*f* formed in a left edge-side outer circumferential surface of the second cylindrical cam 42*a* in such a way as to extend in the circumferential direction of the second cylindrical cam 42*a*, an endless second right edge groove 42*g* formed in a right end side outer circumferential surface of the second cylindrical cam 42*a* in such a way as to extend in the circumferential direction of the second cylindrical cam 42*a*, a second coupling groove 42*h* formed between the second left edge groove 42*f* and the second right edge groove 42*g* in such a way as to extend in the circumferential direction of the second cylindrical cam 42*a*, the second coupling groove 42*h* connected, at one end thereof, to the second left edge groove 42*f* and connected, at the other end thereof, to the second right edge groove 42*g*, a second V-shaped groove 42*i* connected, at one end thereof, to the second coupling groove 42*h* and connected, at the other end thereof, to the second right edge groove 42*g* between the second coupling groove 42*h* and the second right edge groove 42*g*, the second V-shaped groove 42*i* formed in roughly the shape of a letter V, and a second recessed portion 42*j* formed in a corner portion located midway in the second V-shaped groove 42*i*.

The above-described second coupling groove 42*h* is formed from the second left edge groove 42*f* to the second right edge groove 42*g* in the form of a left-handed spiral. Moreover, in the second left edge groove 42*f*, a second left curved portion 42*k* curved to the left side of the second cylindrical cam 42*a* is formed, and a connection at which the second coupling groove 42*h* is connected to the second left edge groove 42*f* is formed in such a way as to coincide with one end of the second left curved portion 42*k* of the second left edge groove 42*f*. In addition, the second left edge groove 42*f* and the second coupling groove 42*h* are connected in such a way that the second left edge groove 42*f* is nearly aligned with the second coupling groove 42*h*. Moreover, in the second right edge groove 42*g*, a second right curved portion 42*m* curved to the right edge side of the second cylindrical cam 42*a* is formed, and a connection at which the second V-shaped groove 42*i* is connected to the second right edge groove 42*g* is formed in such a way as to coincide with one end of the second right curved portion 42*m* of the second right edge groove 42*g*. In addition, the second right edge groove 42*g* and the second V-shaped groove 42*i* are connected in such a way that the second right edge groove 42*g* is nearly aligned with an end of the second V-shaped groove 42*i*. Moreover, one end of the second V-shaped groove 42*i* is connected to the second coupling groove 42*h* near a connection between the second left edge groove 42*f* and the second coupling groove 42*h*, and the other end of the second V-shaped groove 42*i* is connected to the second right edge groove 42*g* near a connection between the second right edge groove 42*g* and the second coupling groove 42*h*. The second recessed portion 42*j* is formed to have a size that allows the second recessed portion 42*j* to house almost half of the second rolling element 42*d*. The remaining half of the second rolling element 42*d* is housed in the second guide groove 42*b*. Furthermore, the second V-shaped groove 42*i* is formed in the shape of a somewhat deformed letter V so that the second rolling element 42*d* housed in the second recessed portion 42*j* is guided to the second coupling groove 42*h*, not to the second right edge groove 42*g*, by the rotation of the second cylindrical cam 42*a*. As a result, after the second wind-up drum 22*c* is rotated in one direction with slight operation of the operating cord 14 in the other direction to lift the second cloth 12 by the second lifting and lowering cord 22*d*, when the hand is disengaged from the operating cord 14, the second stopper 42 stops the rotation of the second wind-up drum 22*c* in a direction in which the second lifting and lowering cord 22*d* is unreeled and the second cloth 12 is lowered, and, after the second wind-up drum 22*c* is rotated again in one direction with slight operation of the operating cord 14 in the other direction from this state to lift the second cloth 12 again by the second lifting and lowering cord 22*d*, when the hand is disengaged from the operating cord 14, the second stopper 42 allows the rotation of the second wind-up drum 22*c* in a direction in which the second lifting and lowering cord 22*d* is unreeled and the second cloth 12 is lowered.

On the other hand, between the first input shaft 21*a* and the first clutch drum 61, a first resistance applying mechanism 81 is provided, and, between the second input shaft 22*a* and the second clutch drum 62, a second resistance applying mechanism 82 is provided (FIGS. 1 and 4). The first resistance applying mechanism is formed of a first pressure contact plate 81*a* fitted over the first cam shaft 31*e* and a first wave washer 81*b* interposed between the first pressure contact plate 81*a* and the first disk 61*a*. The first clutch drum and the first resistance applying mechanism 81 are attached to the first cam shaft 31*e* in a state in which the first clutch drum 61 and the first resistance applying mechanism 81 are sandwiched between a pair of C-shaped snap rings 81*c*, 81*c* and a pair of flat washers 81*d*, 81*d* and a thrust load is applied to the first clutch drum 61 and the first resistance applying mechanism 81 by the first wave washer 81*b*. As a result, rotation of the first clutch drum 61 relative to the first input shaft 21*a* is prevented. Moreover, the second resistance applying mechanism 82 has the same structure as the first resistance applying mechanism 81. The second resistance applying mechanism 82 is formed of a second pressure contact plate 82*a* fitted over the second cam shaft 32*e* and a second wave washer 82*b* interposed between the second pressure contact plate 82*a* and the second disk 62*a*. The second clutch drum 62 and the second resistance applying mechanism 82 are attached to the second cam shaft 32*e* in a state in which the second clutch drum 62 and the second resistance applying mechanism 82 are sandwiched between a pair of C-shaped snap rings 82*c*, 82*c* and a pair of flat washers 82*d*, 82*d* and a thrust load is applied to the second clutch drum and the second resistance applying mechanism 82 by the second wave washer 82*b*. As a result, rotation of the second clutch drum 62 relative to the second input shaft 22*a* is prevented.

On the other hand, in the first engaging sections 31*b*, a first return spring mechanism 91 is provided, and, in the second engaging sections 32*b*, a second return spring mechanism 92 is provided (FIGS. 1 and 3). The first return spring mechanism 91 is formed of a first base 91*a* rotatably fitted over the first cam shaft 31*e*, three first curved arm sections 91*b* jutting from the first base 91*a* while being curved outward in the radial direction of the first input shaft 21*a*, and three first pin sections 91*c* provided at the tips of the three first curved arm sections 91*b* (FIG. 3). The first base 91*a*, the three first curved arm sections 91*b*, and the three first pin sections 91*c* are integrally formed of synthetic resin, and the first pin sections 91*c* at the tips of the three first curved arm sections 91*b* are attached by insertion to portions near the tips of the three first engaging sections 31*b*. Moreover, the angles, which the first curved arm sections 91*b* form with the adjacent first curved arm sections 91*b*, are set at the same angle (120 degrees). Furthermore, when an application of the external force acting on the first engaging sections 31*b* is ended in a state in which the first engaging sections 31*b* jut to the outside in the radial direction of the first input shaft 21*a* (FIG. 3(*a*)), the elasticity of resin of the first curved arm sections 91*b* retracts the first engaging sections 31*b* to the inside in the radial direction of the first input shaft 21*a* (FIG. 3(*b*)). Moreover, the second return spring mechanism 92 has the same structure as the first return spring mechanism 91 and is formed of a second base 92*a* rotatably fitted over the second cam shaft 32*e*, three second curved arm sections 92*b* jutting from the second base 92*a* while being curved outward in the radial direction of the second input shaft 22*a*, and three second pin sections 92*c* provided at the tips of the three second curved arm sections 92*b* (FIG. 3). The second base 92*a*, the three second curved arm sections 92*b*, and the three second pin sections 92*c* are integrally formed of synthetic resin, and the second pin sections 92*c* at the tips of the three second curved arm sections 92*b* are attached by insertion to portions near the tips of the three second engaging sections 32*b*.

Moreover, the angles, which the second curved arm sections 92*b* form with the adjacent second curved arm sections 92*b*, are set at the same angle (120 degrees). Furthermore, when an application of the external force acting on the second engaging sections 32*b* is ended in a state in which the second engaging sections 32*b* jut to the outside in the radial direction of the second input shaft 22*a* (FIG. 3(*a*)), the elasticity of resin of the second curved arm section 92*b* retracts the second engaging sections 32*b* to the inside in the radial direction of the second input shaft 22*a* (FIG. 3(*b*)).

The operation of the roman shade 10 structured as described above will be described. When the operating cord 14 is pulled in one direction, the pulley 26 rotates in one direction, and the turning force of the pulley 26 in one direction is transferred to the first input shaft 21*a* via the drive shaft 27. When the first input shaft 21*a* rotates in one direction, the first arm sections 71*a* of the first cam 71 rotate in one direction (a direction indicated by a solid arrow in FIG. 2(*a*)) as shown in FIGS. 2(*a*) to 2(*f*), whereby the first engaging sections 31*b* rotate about the first supporting shafts 61*c* as shown in FIGS. 2(*a*) to 2(*f*), gradually jut to the outside in the radial direction of the first input shaft 21*a*, and engage the first engaged sections 31*d* (FIG. 2(*f*) and FIG. 3(*b*)). As a result, since the turning force of the first input shaft 21*a* in one direction is transferred to the first output shaft 21*b* via the first clutch 31, the first wind-up drum 21*c* rotates in one direction, the first lifting and lowering cord 21*d* is wound around the first wind-up drum 21*c*, and the first cloth 11 rises. At this time, the first cylindrical cam 41*a* rotates in such a way that the first rolling element 41*d* of the first stopper 41 rolls in the first right edge groove 41*g* in the direction indicated by a solid arrow in FIG. 5. On the other hand, although the turning force of the pulley 26 in one direction is transferred to the second clutch 32 via the drive shaft 27, the first gear 51, the second gear 52, and the second input shaft 22*a*, the second clutch 32 does not transfer the turning force of the pulley 26 in one direction to the second output shaft 22*b*. The reason is as follows (hereinafter, referred to as a first reason). When the pulley 26 rotates in one direction, the direction of rotation of the second input shaft 22*a* is reversed by the engagement between the first gear 51 and the second gear 52, and the second input shaft 22*a* rotates in the other direction. As a result, since the second arm sections 72*a* of the second cam 72 rotate in the other direction (a direction indicated by a dashed arrow in FIG. 2(*a*)), the second arm sections 72*a* do not push the second engaging sections 32*b* to the outside in the radial direction of the second input shaft 22*a*, and the second engaging sections 32*b* are maintained in a state in which the second engaging sections 32*b* are retracted in the radial direction of the second input shaft 22*a* by the elasticity of resin of the second curved arm sections 92*b* of the second return spring mechanism 92 (FIG. 2(*a*) and FIG. 3(*a*)). Therefore, the second clutch 32 does not transfer the turning force of the pulley 26 in one direction to the second output shaft 22*b*.

When the hand is disengaged from the operating cord 14 in this state, since the first rolling element 41*d* is housed in the first recessed portion 41*j* due to the weight of the first cloth 11, even when the turning force in a direction in which the first cloth 11 is unreeled due to the weight of the first cloth 11 acts on the first output shaft 21*b*, the first output shaft 21*b* does not rotate, and the first cloth 11 stops. At this time, the first cylindrical cam 41*a* of the first stopper 41 slightly rotates less than 360 degrees in a direction in which the first cloth 11 is unreeled, and, although the first output shaft 21*b* also rotates in the same direction, the rotation of the first output shaft 21*b* is hardly transferred to the first and second input shafts 21*a* and 22*a*. The reason is as follows (hereinafter referred to as a second reason). Since the rotation of the first output shaft 21*b* is the rotation in a direction in which the first engaging sections 31*b* are moved out of engagement with the first engaged sections 31*d* of the first output drum 31*a*, only when the first input shaft 21*a* rotates about 50 degrees, which is an extremely small angle, the first engaging sections 31*b* are moved out of engagement with the first engaged sections 31*d*. As a result, since the turning force of the above-described first output shaft 21*b* is hardly transferred to the first input shaft 21*a*, the turning force of the above-described first output shaft 21*b* is also hardly transferred to the second input shaft 22*a*.

When the operating cord 14 is slightly pulled in one direction, for example, when the first cylindrical cam 41*a* is rotated 0.2 to 0.3 turn while the first cloth 11 is in a stopped state by the first stopper 41, that is, while the first rolling element 41*d* is maintained in a state in which the first rolling element 41*d* is housed in the first recessed portion 41*j*, the first rolling element 41*d* enters the first coupling groove 41*h*. When the hand is disengaged from the operating cord 14 in this state, the first rolling element 41*d* enters the first left edge groove 41*f* due to the weight of the first cloth 11, the first cylindrical cam 41*a* rotates in such a way that the first rolling element 41*d* rolls in the first left edge groove 41*f* in the direction indicated by a dashed arrow in FIG. 5, and the first cloth 11 is switched to a falling state. At this time, although the turning force of the pulley 26 in one direction is transferred to the second clutch 32 via the drive shaft 27, the first gear 51, the second gear 52, and the second input shaft 22*a*, the second clutch 32 does not transfer the turning force of the pulley 26 in one direction to the second output shaft 22*b*. The reason is the same as the first reason described above. Then, when the first cloth 11 is switched to a falling state, the first cylindrical cam 41*a* of the first stopper 41 rotates in a direction in which the first cloth 11 is unreeled, and the first output shaft 21*b* also rotates in the same direction. However, the rotation of the first output shaft 21*b* is hardly transferred to the first and second input shafts 21*a* and 22*a*. The reason is the same as the second reason described above. Incidentally, to stop the falling of the first cloth 11, the operating cord 14 is pulled in one direction. Moreover, a first speed controller (not shown) functioning as a centrifugal brake is provided in the head rail 13, and the first speed controller reduces the rotational speed of the first output shaft 21*b* when the rotational speed becomes excessively high.

On the other hand, when the operating cord 14 is pulled in the other direction, the pulley 26 rotates in the other direction, and the turning force of the pulley 26 in the other direction is transferred to the second input shaft 22*a* via the drive shaft 27, the first gear 51, and the second gear 52. At this time, due to the engagement between the first gear 51 and the second gear 52, the direction of rotation of the second input shaft 22*a* becomes opposite to the direction of rotation of the pulley 26, and the second input shaft 22*a* rotates in one direction. When the second input shaft 22*a* rotates in one direction, the second arm sections 72*a* of the second cam 72 rotate in one direction (a direction indicated by a solid arrow in FIG. 2(*a*)) as shown in FIGS. 2(*a*) to 2(*f*), whereby the second engaging sections 32*b* rotate about the second supporting shafts 62*c* as shown in FIGS. 2(*a*) to 2(*f*), gradually jut to the outside in the radial direction of the second input shaft 22*a*, and engage the second engaged sections 32*d* (FIG. 2(*f*) and FIG. 3(*b*)). As a result, since the turning force of the second input shaft 22*a* in one direction is transferred to the second output shaft 22*b* via the second clutch 32, the second wind-up drum 22*c* rotates in one direction, the second lifting and lowering cord 22*d* is wound around the second wind-up drum 22*c*, and the second cloth 12 rises. At this time, the second cylindrical cam 42*a* rotates in such a way that the second rolling element 42*d* of the second stopper 42 rolls in the second right edge groove 42*g* in the direction indicated by a solid arrow in FIG. 5. On the other hand, although the turning force of the pulley 26 in the other direction is transferred to the first clutch 31 via the drive shaft 27 and the first input shaft 21*a*, the first clutch 31 does not transfer the turning force of the pulley 26 in the other direction to the first output shaft 21*b*. The reason is as follows (hereinafter, referred to as a third reason). When the pulley 26 rotates in the other direction, since the first arm sections 71*a* of the first cam 71 rotate in the other direction (a direction indicated by a dashed arrow in FIG. 2(*a*)), the first arm sections 71*a* do not push the first engaging sections 31*b* to the outside in the radial direction of the first input shaft 21*a*, and the first engaging sections 31*b* are maintained in a state in which the first engaging sections 31*b* are retracted in the radial direction of the first input shaft 21*a* by the elasticity of resin of the first curved arm sections 91*b* of the first return spring mechanism 91 (FIG. 2(*a*) and FIG. 3(*a*)). Therefore, the first clutch 31 does not transfer the turning force of the pulley 26 in the other direction to the first output shaft 21*b*.

When the hand is disengaged from the operating cord 14 in this state, since the second rolling element 42*d* is housed in the second recessed portion 42*j* due to the weight of the second cloth 12, even when the turning force in a direction in which the second cloth 12 is unreeled due to the weight of the second cloth 12 acts on the second output shaft 22*b*, the second output shaft 22*b* does not rotate, and the second cloth 12 stops. At this time, the second cylindrical cam 42*a* of the second stopper 42 slightly rotates less than 360 degrees in a direction in which the second cloth 12 is unreeled, and, although the second output shaft 22*b* also rotates in the same direction, the rotation of the second output shaft 22*b* is hardly transferred to the second and first input shafts 22*a* and 21*a*. The reason is as follows (hereinafter referred to as a fourth reason). Since the rotation of the second output shaft 22*b* is the rotation in a direction in which the second engaging sections 32*b* are moved out of engagement with the second engaged sections 32*d* of the second output drum 32*a*, only when the second input shaft 22*a* rotates about 50 degrees, which is an extremely small angle, the second engaging sections 32*b* are moved out of engagement with the second engaged sections 32*d*. As a result, since the turning force of the above-described second output shaft 22*b* is hardly transferred to the second input shaft 22*a*, the turning force of the above-described second output shaft 22*b* is also hardly transferred to the first input shaft 21*a*.

When the operating cord 14 is slightly pulled in the other direction, for example, when the second cylindrical cam 42*a* is rotated 0.2 to 0.3 turn while the second cloth 12 is in a stopped state by the second stopper 42, that is, when the second rolling element 42*d* is maintained in a state in which the second rolling element 42*d* is housed in the second recessed portion 42*j*, the second rolling element 42*d* enters the second coupling groove 42*h*. When the hand is disengaged from the operating cord 14 in this state, the second rolling element 42*d* enters the second left edge groove 42*f* due to the weight of the second cloth 12, the second cylindrical cam 42*a* rotates in such a way that the second rolling element 42*d* rolls in the second left edge groove 42*f* in the direction indicated by a dashed arrow in FIG. 5, and the second cloth 12 is switched to a falling state. At this time, although the turning force of the pulley 26 in the other direction is transferred to the first clutch 31 via the drive shaft 27 and the first input shaft 21*a*, the first clutch 31 does not transfer the turning force of the pulley 26 in the other direction to the first output shaft 21*b*. The reason is the same as the third reason described above. Then, when the second cloth 12 is switched to a falling state, the second cylindrical cam 42*a* of the second stopper 42 rotates in a direction in which the second cloth 12 is unreeled, and the second output shaft 22*b* also rotates in the same direction. However, the rotation of the second output shaft 22*b* is hardly transferred to the second and first input shafts 22*a* and 21*a*. The reason is the same as the fourth reason described above.

Incidentally, to stop the falling of the second cloth 12, the operating cord 14 is pulled in the other direction. Moreover, a second speed controller (not shown) functioning as a centrifugal brake is provided in the head rail 13, and the second speed controller reduces the rotational speed of the second output shaft 22*b* when the rotational speed becomes excessively high. Therefore, it is possible to lift and lower the first and second clothes 11 and 12 independently.

On the other hand, since the first resistance applying mechanism 81 is provided between the first input shaft 21*a* and the first clutch drum 61, at the time of initial torque of the first input shaft 21*a*, the first clutch drum 61 follows the rotation of the first input shaft 21*a* by the first resistance applying mechanism 81. As a result, the first engaging sections 31*b* attached to the first clutch drum 61 do not accidentally engage the first engaged sections 31*d* of the first output drum 31*a*. Moreover, since the second resistance applying mechanism 82 is provided between the second input shaft 22*a* and the second clutch drum 62, at the time of initial torque of the second input shaft 22*a*, the second clutch drum 62 follows the rotation of the second input shaft 22*a* by the second resistance applying mechanism 82. As a result, the second engaging sections 32*b* attached to the second clutch drum 62 do not accidentally engage the second engaged sections 32*d* of the second output drum 32*a*. Therefore, it is possible to lift and lower reliably the first and second clothes 11 and 12 independently with operation of one operating cord 14.

Moreover, as shown in FIG. 3(*b*) in detail, since an angle α which a flat surface of the first engaged section 31*d*, the flat surface at which the first engaged section 31*d* makes contact with the first engaging section 31*b*, forms with a flat surface making contact with an outer circumferential surface of the first cylindrical section 31*c* in the first engaged section 31*d* is set at an acute angle (in this embodiment, about 63 degrees), that is, since vector setting is made so that, when the first cylindrical section 31*c* rotates in a direction (a direction indicated by a chain double-dashed arrow in FIG. 3(*b*)) in which the first engaged section 31*d* is brought into contact with the first engaging section 31*b* by pressure, the first engaging section 31*b* escapes in the circumferential direction by using the turning force from the first cylindrical section 31*c*, the first engaged section 31*d* rarely bites mechanically the first engaging section 31*b* and the first engaging section 31*b* rarely bites mechanically the first arm section 71*a*. As a result, the first engaging section 31*b* is promptly removed from the first engaged section 31*d*.

Furthermore, as shown in FIG. 3(*b*) in detail, since an angle α which a flat surface of the second engaged section 32*d*, the flat surface at which the second engaged section 32*d* makes contact with the second engaging section 32*b*, forms with a flat surface making contact with an outer circumferential surface of the second cylindrical section 32*c* in the second engaged section 32*d* is set at an acute angle (in this embodiment, about 63 degrees), that is, since vector setting is made so that, when the second cylindrical section 32*c* rotates in a direction (a direction indicated by a chain double-dashed arrow in FIG. 3(*b*)) in which the second engaged section 32*d* is brought into contact with the second engaging section 32*b* by pressure, the second engaging section 32*b* escapes in the circumferential direction by using the turning force from the second cylindrical section 32*c*, the second engaged section 32*d* rarely bites mechanically the second engaging section 32*b* and the second engaging section 32*b* rarely bites mechanically the second arm section 72*a*. As a result, the second engaging section 32*b* is promptly removed from the second engaged section 32*d*.

<Second Embodiment>

Figure 8:
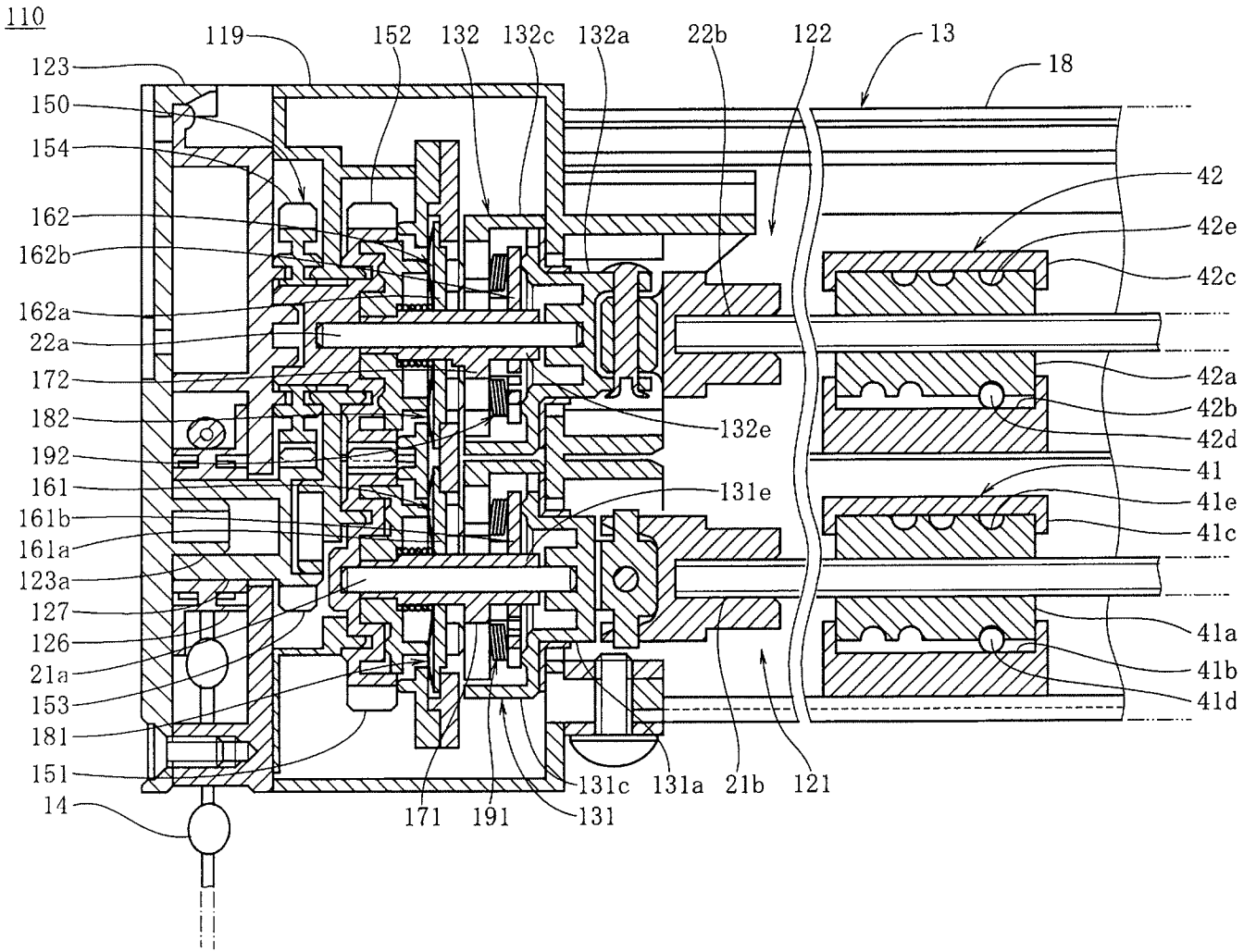
FIG. 8 is an enlarged sectional view showing a roman shade of a second embodiment of the present invention, the enlarged sectional view corresponding to FIG. 1.
Figure 9:
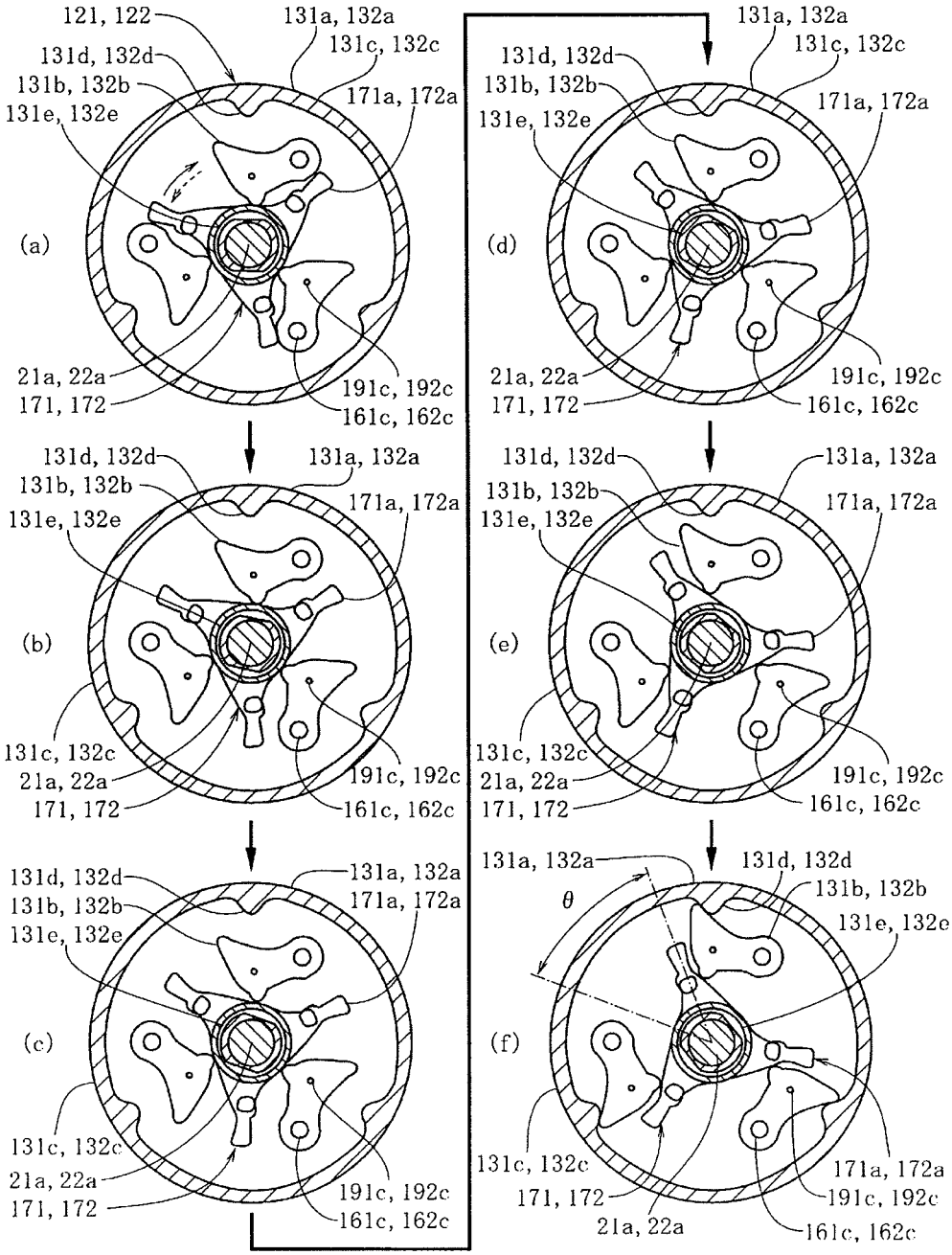
FIG. 9 is a sectional view showing a state in which first and second engaging sections are engaging first and second engaged sections by the rotation of first and second cams, the sectional view corresponding to FIG. 2.
Figure 10:
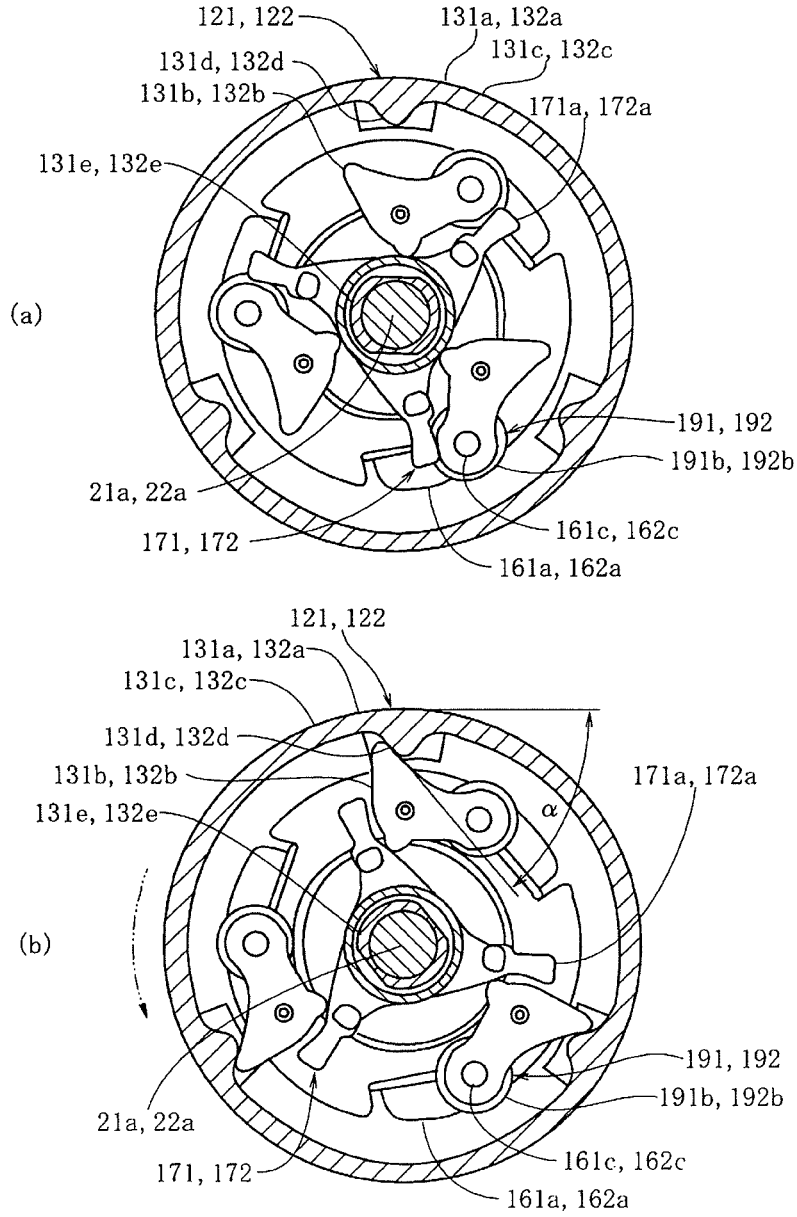
FIG. 10(*a*) is a sectional view showing a state in which the first and second engaging sections are retracted by being rotated to the inside in the radial direction of first and second input shafts by first and second return spring mechanisms, the sectional view corresponding to FIG. 9(*a*), and FIG. 10(*b*) is a sectional view showing a state in which the first and second engaging sections jut by being rotated to the outside in the radial direction of the first and second input shafts by the first and second return spring mechanisms, the sectional view corresponding to FIG. 9(*f*)

FIGS. 8 to 11 show a second embodiment of the present invention. In FIGS. 8 to 11, the same reference characters as those in FIGS. 1 to 4 denote the same parts. In this embodiment, as shown in FIG. 10(*b*) in detail, an angle α which a flat surface of a first engaged section 131*d*, the flat surface at which the first engaged section 131*d* makes contact with a first engaging section 131*b*, forms with a flat surface making contact with an outer circumferential surface of a first cylindrical section 131*c* in the first engaged section 131*d* is set at an acute angle (in this embodiment, about 50 degrees) which is smaller than the angle in the first embodiment, and an angle α which a flat surface of a second engaged section 132*d*, the flat surface at which the second engaged section 132*d* makes contact with a second engaging section 132*b*, forms with a flat surface making contact with an outer circumferential surface of a second cylindrical section 132*c* in the second engaged section 132*d* is set at an acute angle (in this embodiment, about 50 degrees) which is smaller than the angle in the first embodiment.

On the other hand, as shown in FIG. 8, a pulley 126 is rotatably housed in a pulley case 123. Specifically, in the pulley case 123, a boss 123*a* is provided in such a way as to project to the inside of the case 123 toward a lower space 18*f* of a rail main body 18, a drive shaft 127 is rotatably fitted over the boss 123*a*, and the pulley 126 is fitted (spline fitted) to the drive shaft 127 in such a way that relative rotation is impossible. Moreover, around the pulley 126, a ring-shaped (endless) ball chain operating cord 14 is wound. In the above-described drive shaft 127, a drive gear 153 is integrally provided in such a way as to be located between the pulley case 123 and a clutch case 119. Furthermore, to the pulley case 123 and the clutch case 119, an intermediate gear 154 that is located between the pulley case 123 and the clutch case 119 and engages the above-described drive gear 153 is rotatably attached. To the intermediate gear 154, one end of a second input shaft 22*a* of a second lifting and lowering unit 122 is attached by insertion, and, a second driven gear 152 is fitted over the second input shaft 22*a* in such a way as to be located in an upper part of the clutch case 119. Furthermore, to a lower part of the clutch case 119, one end of a first input shaft 21*a* of a first lifting and lowering unit 121 is rotatably attached, and a first driven gear 151 that is located inside the clutch case 119 and engages the second driven gear 152 is fitted over the first input shaft 21*a*. The turning force of the pulley 126 is transferred to the second input shaft 22*a* via the drive shaft 127, the drive gear 153, the intermediate gear 154, and the second driven gear 152 and is transferred to the first input shaft 21*a* via the drive shaft 127, the drive gear 153, the intermediate gear 154, the second driven gear 152, and the first driven gear 151. In addition, the drive gear 153 is formed to have a smaller number of teeth than the intermediate gear 154, and the first driven gear 151 is formed to have the same number of teeth as that of the second driven gear 152. The above-described drive gear 153, intermediate gear 154, first driven gear 151, and second driven gear 152 form a turning force transfer mechanism 150.

Figure 11:
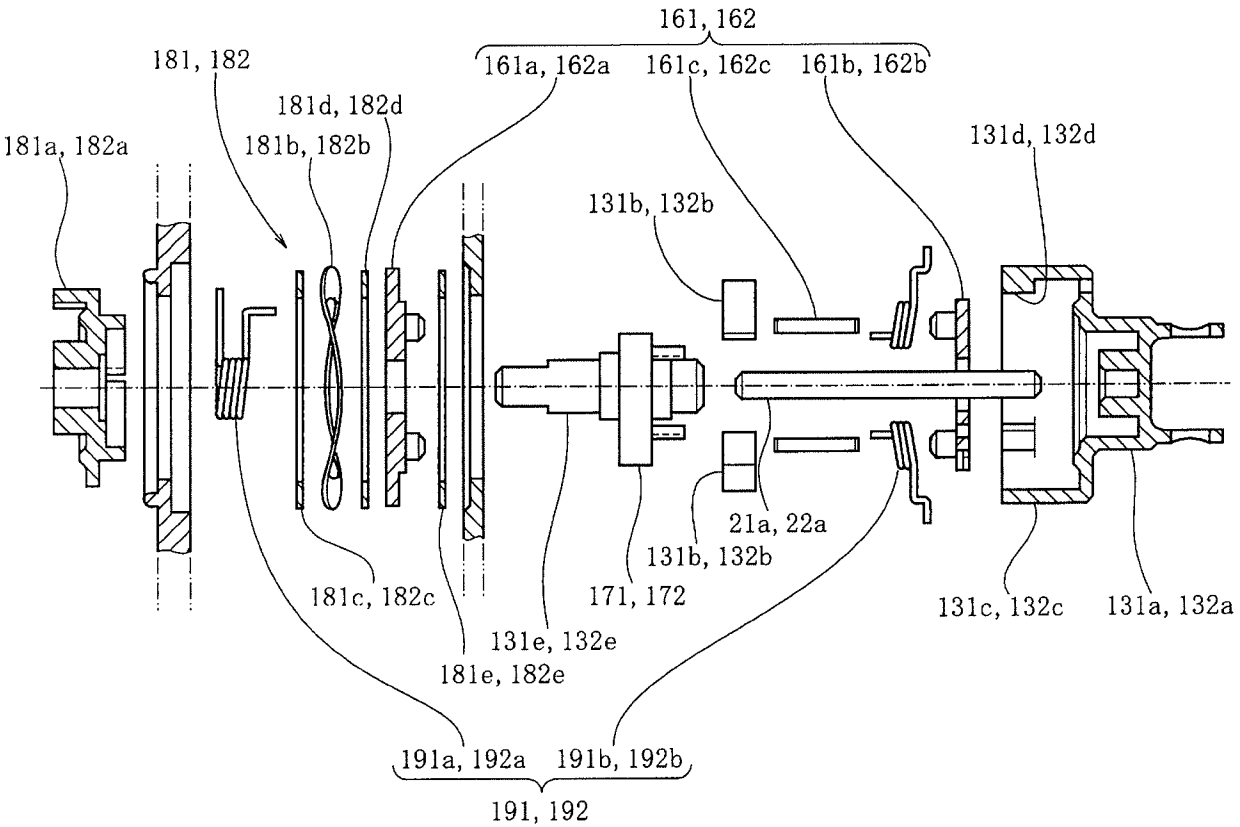
FIG. 11 is an exploded sectional view of first and second clutches.

A first clutch 131 is housed in the lower part of the clutch case 119 (FIG. 8). The first clutch 131 has a first output drum 131*a* attached to a first output shaft 21*b* in such a way that the first output drum 131*a* cannot rotate, a first clutch drum 161 rotatably fitted over the first input shaft 21*a*, a first cam 171 fitted over the first input shaft 21*a* in such a way that the first cam 171 cannot rotate, and first engaging sections 131*b* revolvably attached to the first clutch drum 161 (FIGS. 8, 9, and 11). In the first output drum 131*a*, the large diameter first cylindrical section 131*c* that is loosely fitted over the first input shaft 21*a* is provided, and, in an inner circumferential surface of the first cylindrical section 131*c*, three first engaged sections 131*d* are formed at regular intervals (equiangularly) in a circumferential direction. Moreover, a first cam shaft 131*e* is fitted over the first input shaft 21*a* in such a way that relative rotation is impossible. The first clutch drum 161 is formed of a pair of first disks 161*a* and 161*b*, each having a diameter slightly smaller than the inside diameter of the first cylindrical section 131*c*, and three first supporting shafts 161*c* connecting the first disks 161*a* and 161*b* to each other with a predetermined space left between them. The pair of first disks 161*a* and 161*b* is loosely inserted into the first cylindrical section 131*c* in a state in which the pair of first disks 161*a* and 161*b* is rotatably fitted over the first cam shaft 131*e*. Moreover, the three first supporting shafts 161*c* are disposed on the same circumference of a circle having a center on the central axis of the first disks 161*a* and 161*b* at regular intervals (equiangularly) in a circumferential direction, and, in this state, both ends of each of the three first supporting shafts 161*c* are attached by insertion to the pair of first disks 161*a* and 161*b*. The above-described first clutch drum 161 is located inside the first cylindrical section 131*c*.

The first cam 171 is formed integrally with the first cam shaft 131*e* (FIGS. 8, 9, and 11). As a result, the first cam 171 cannot rotate with respect to the first input shaft 21*a*. Moreover, the first cam 171 is formed of three first arm sections 171*a* radially extending to the outside in the radial direction of the first input shaft 21*a* in such a way that the three first arm sections 171*a* are located inside the first cylindrical section 131*c*. Furthermore, the first arm sections 171*a* are each tapered from the base end toward the tip, and the angles, which the first arm sections 171*a* form with the adjacent first arm sections 171*a*, are set at the same angle (120 degrees). In this embodiment, three first engaging sections 131*b* are provided, and the first engaging sections 131*b* are each shaped like a letter L. The base ends of the three first engaging sections 131*b* are revolvably fitted over the three first supporting shafts 161*c*. As a result, the three first engaging sections 131*b* are revolvably attached to an inner surface of the first clutch drum 161 in a state in which the three first engaging sections 131*b* are sandwiched between the pair of first disks 161*a* and 161*b*. Moreover, bending outer corner portions of the three first engaging sections 131*b* each face a corresponding one of the base ends of the three first arm sections 171*a*, and the tips of the three first engaging sections 131*b* each face a corresponding one of the three first engaged sections 131*d*. Furthermore, as a result of the first arm sections 171*a* engaging the first engaging sections 131*b* at the time of rotation of the pulley 126 in one direction, the first engaging sections 131*b* rotate about the first supporting shafts 161*c* in one direction, and the tips of the first engaging sections 131*b* jut to the outside in the radial direction of the first input shaft 21*a* and engage the first engaged sections 131*d;* at the time of rotation of the pulley 126 in the other direction or at the time of rotation of the first output shaft 21*b*, the first engaging sections 131*b* rotate about the first supporting shafts 161*c* in the other direction, and the tips of the first engaging sections 131*b* are retracted to the inside in the radial direction of the first input shaft 21*a* and do not engage the first engaged sections 131*d*. That is, as a result of the first engaging sections 131*b* rotating to the outside in the radial direction of the first input shaft 21*a* at the time of rotation of the pulley 126 in one direction, the first output shaft 21*b* engages the first input shaft 21*a* and rotates in synchronization with the first input shaft 21*a;* as a result of the first engaging sections 131*b* rotating to the inside in the radial direction of the first input shaft 21*a* at the time of rotation of the pulley 126 in the other direction or at the time of rotation of the first output shaft 21*b*, the first output shaft 21*b* is moved out of engagement with the first input shaft 21*a* and stops rotating in synchronization with the first input shaft 21*a*. Incidentally, an angle θ at which the first arm sections 171*a* rotate from a state in which the first engaging sections 131*b* are retracted to the innermost positions in the radial direction of the first input shaft 21*a* (FIG. 9(*a*)) to a state in which the first engaging sections 131*b* jut to the outermost positions in the radial direction of the first input shaft 21*a* (FIG. 9(*f*)) is about 50 degrees and is extremely small.

On the other hand, the second clutch 132 has the same structure as the first clutch 131 and is housed in the upper part of the clutch case 119 (FIG. 8). The second clutch 132 has the above-described second output drum 132*a* attached to the second output shaft 22*b* in such a way that the second output drum 132*a* cannot rotate, a second clutch drum 162 rotatably fitted over the second input shaft 22*a*, a second cam 172 fitted over the second input shaft 22*a* in such a way that the second cam 172 cannot rotate, and second engaging sections 132*b* revolvably attached to the second clutch drum 162 (FIGS. 8, 9, and 11). In the second output drum 132*a*, the large diameter second cylindrical section 132*c* that is loosely fitted over the second input shaft 22*a* is provided, and, in an inner circumferential surface of the second cylindrical section 132*c*, three second engaged sections 132*d* are formed at regular intervals (equiangularly) in a circumferential direction. Moreover, a second cam shaft 132*e* is fitted over the second input shaft 22*a* in such a way that relative rotation is impossible. The second clutch drum 162 is formed of a pair of second disks 162*a* and 162*b*, each having a diameter slightly smaller than the inside diameter of the second cylindrical section 132*c*, and three second supporting shafts 162*c* connecting the second disks 162*a* and 162*b* to each other with a predetermined space left between them. The pair of second disks 162*a* and 162*b* is loosely inserted into the second cylindrical section 132*c* in a state in which the pair of second disks 162*a* and 162*b* is rotatably fitted over the second cam shaft 132*e*. Moreover, the three second supporting shafts 162*c* are disposed on the same circumference of a circle having a center on the central axis of the second disks 162*a* and 162*b* at regular intervals (equiangularly) in a circumferential direction, and, in this state, both ends of each of the three second supporting shafts 162*c* are attached by insertion to the pair of second disks 162*a* and 162*b*. The above-described second clutch drum 162 is located inside the second cylindrical section 132*c*.

The second cam 172 is formed integrally with the second cam shaft 132*e* (FIGS. 8, 9, and 11). As a result, the second cam 172 cannot rotate with respect to the second input shaft 22*a*. Moreover, the second cam 172 is formed of three second arm sections 172*a* radially extending to the outside in the radial direction of the second input shaft 22*a* in such a way that the three second arm sections 172*a* are located inside the second cylindrical section 132*c*. Furthermore, the second arm sections 172*a* are each tapered from the base end toward the tip, and the angles, which the second arm sections 172*a* form with the adjacent second arm sections 172*a* are set at the same angle (120 degrees). In this embodiment, three second engaging sections 132*b* are provided, and the second engaging sections 132*b* are each shaped like a letter L. The base ends of the three second engaging sections 132*b* are revolvably fitted over the three second supporting shafts 162*c*. As a result, the three second engaging sections 132*b* are revolvably attached to an inner surface of the second clutch drum 162 in a state in which the three second engaging sections 131*b* are sandwiched between the pair of second disks 162*a* and 162*b*. Moreover, bending outer corner portions of the three second engaging sections 132*b* each face a corresponding one of the base ends of the three second arm sections 172*a*, and the tips of the three second engaging sections 132*b* each face a corresponding one of the three second engaged sections 132*d*. Furthermore, as a result of the second arm sections 172*a* engaging the second engaging sections 132*b* at the time of rotation of the pulley 126 in the other direction, the second engaging sections 132*b* rotate about the second supporting shafts 162*c* in one direction, and the tips of the second engaging sections 132*b* jut to the outside in the radial direction of the second input shaft 22*a* and engage the second engaged sections 132*d;* at the time of rotation of the pulley 126 in one direction or at the time of rotation of the second output shaft 22*b*, the second engaging sections 132*b* rotate about the second supporting shafts 162*c* in the other direction, and the tips of the second engaging sections 132*b* are retracted to the inside in the radial direction of the second input shaft 22*a* and do not engage the second engaged sections 132*d*. That is, as a result of the second engaging sections 132*b* rotating to the outside in the radial direction of the second input shaft 22*a* at the time of rotation of the pulley 126 in the other direction, the second output shaft 22*b* engages the second input shaft 22*a* and rotates in synchronization with the second input shaft 22*a;* as a result of the second engaging sections 132*b* rotating to the inside in the radial direction of the second input shaft 22*a* at the time of rotation of the pulley 126 in one direction or at the time of rotation of the second output shaft 22*b*, the second output shaft 22*b* is moved out of engagement with the second input shaft 22*a* and stops rotating in synchronization with the second input shaft 22*a*. Incidentally, an angle θ at which the second arm sections 172*a* rotate from a state in which the second engaging sections 132*b* are retracted to the innermost positions in the radial direction of the second input shaft 22*a* (FIG. 9(*a*)) to a state in which the second engaging sections 132*b* jut to the outermost positions in the radial direction of the second input shaft 22*a* (FIG. 9(*f*)) is about 50 degrees and is extremely small.

On the other hand, between the first input shaft 21*a* and the first clutch drum 161, a first resistance applying mechanism 181 is provided, and, between the second input shaft 22*a* and the second clutch drum 162, a second resistance applying mechanism 182 is provided (FIGS. 8 and 11). The first resistance applying mechanism 181 is formed of a first pressure contact plate 181*a* fitted over the first cam shaft 131*e* and a first wave washer 181*b* interposed between the first pressure contact plate 181*a* and the first disk 161*a*. On both sides of the first wave washer 181*b* and an end face of the first disk 161*a*, flat washers 181*c* to 181*e* are placed, and a thrust load is applied to the first disk 161*a* and the first pressure contact plate 181*a* by the first wave washer 181*b*. As a result, rotation of the first clutch drum 161 relative to the first input shaft 21*a* is prevented. Moreover, the second resistance applying mechanism 182 has the same structure as the first resistance applying mechanism 181. The second resistance applying mechanism 182 is formed of a second pressure contact plate 182*a* fitted over the second cam shaft 132*e* and a second wave washer 182*b* interposed between the second pressure contact plate 182*a* and the second disk 162*a*. On both sides of the second wave washer 182*b* and an end face of the second disk 162*a*, flat washers 182*c* to 182*e* are placed, and a thrust load is applied to the second disk 162*a* and the second pressure contact plate 182*a* by the second wave washer 182*b*. As a result, rotation of the second clutch drum 162 relative to the second input shaft 22*a* is prevented.

On the other hand, in the first cam shaft 131*e* and the first engaging sections 131*b*, a first return spring mechanism 191 is provided, and, in the second cam shaft 132*e* and the second engaging sections 132*b*, a second return spring mechanism 192 is provided (FIGS. 8, 10, and 11). The first return spring mechanism 191 has a first cam spring 191*a* fitted over the first cam shaft 131*e* and first engaging section springs 191*b* fitted over the first supporting shafts 161*c*. The first cam spring 191*a* is a torsional coil spring that urges the first cam 171, the first cam shaft 131*e*, and the first input shaft 21*a* toward the first disks in such a way that the first cam 171, the first cam shaft 131*e*, and the first input shaft 21*a* rotate in the other direction (a direction indicated by a dashed arrow in FIG. 9(*a*)), and the first engaging section springs 191*b* are torsional coil springs that urge the first engaging sections 131*b* toward the first disks 161*a* and 161*b* in such a way that the first engaging sections 131*b* rotate about the first supporting shafts 161*c* in a direction in which the first engaging sections 131*b* are removed from the first engaged sections 131*d*. Moreover, the second return spring mechanism 192 has a second cam spring 192*a* fitted over the second cam shaft 132*e* and second engaging section springs 192*b* fitted over the second supporting shafts 162*c*. The second cam spring 192*a* is a torsional coil spring that urges the second cam 172, the second cam shaft 132*e*, and the second input shaft 22*a* toward the second disks 162*a* and 162*b* in such a way that the second cam 172, the second cam shaft 132*e*, and the second input shaft 22*a* rotate in the other direction (a direction indicated by a dashed arrow in FIG. 9(*a*)), and the second engaging section springs 192*b* are torsional coil springs that urge the second engaging sections 132*b* toward the second disks 162*a* and 162*b* in such a way that the second engaging sections 132*b* rotate about the second supporting shafts 162*c* in a direction in which the second engaging sections 132*b* are removed from the second engaged sections 132*d*. Since the above-described first and second return spring mechanisms 191 and 192 use torsional coil springs made of spring steel, the first and second return spring mechanisms 191 and 192 have greater durability than the first and second return spring mechanisms of the first embodiment, the first and second return spring mechanisms using the elasticity of resin. In other respects, this embodiment has the same structure as the first embodiment.

In a roman shade 110 structured as described above, as shown in FIG. 10(*b*) in detail, since an angle α which a flat surface of the first engaged section 131*d*, the flat surface at which the first engaged section 131*d* makes contact with the first engaging section 131*b*, forms with a flat surface making contact with an outer circumferential surface of the first cylindrical section 131*c* in the first engaged section 131*d* is set at an acute angle (in this embodiment, about 50 degrees) which is smaller than the angle in the first embodiment, that is, since vector setting is made so that, when the first cylindrical section 131*c* rotates in a direction (a direction indicated by a chain double-dashed arrow in FIG. 10(*b*)) in which the first engaged section 131*d* is brought into contact with the first engaging section 131*b* by pressure, the first engaging section 131*b* escapes in the circumferential direction by using the turning force from the first cylindrical section 131*c* more easily than in the first embodiment, the first engaged section 131*d* more rarely bites mechanically the first engaging section 131*b* and the first engaging section 131*b* more rarely bites mechanically the first arm section 171*a* than in the first embodiment. As a result, the first engaging section 131*b* is removed from the first engaged section 131*d* more promptly.

Moreover, as shown in FIG. 10(*b*) in detail, since an angle α which a flat surface of the second engaged section 132*d*, the flat surface at which the second engaged section 132*d* makes contact with the second engaging section 132*b*, forms with a flat surface making contact with an outer circumferential surface of the second cylindrical section 132*c* in the second engaged section 132*d* is set at an acute angle (in this embodiment, about 50 degrees), that is, since vector setting is made so that, when the second cylindrical section 132*c* rotates in a direction (a direction indicated by a chain double-dashed arrow in FIG. 10(*b*)) in which the second engaged section 132*d* is brought into contact with the second engaging section 132*b* by pressure, the second engaging section 132*b* escapes in the circumferential direction by using the turning force from the second cylindrical section 132*c* more easily than in the first embodiment, the second engaged section 132*d* more rarely bites mechanically the second engaging section 132*b* and the second engaging section 132*b* more rarely bites mechanically the second arm section 172*a* than in the first embodiment. As a result, the second engaging section 132*b* is removed from the second engaged section 132*d* more promptly. The other operations are the same as those of the first embodiment and therefore overlapping explanations are omitted.

Incidentally, in the first and second embodiments described above, the roman shade has been taken up as an example of the solar radiation shielding apparatus; however, the solar radiation shielding apparatus may be a horizontal blind, a pleated screen, and the like. Moreover, in the first and second embodiments described above, the pulley has been taken up as an example of a rotating member; however, the rotating member may be a sprocket or other rotating members. Moreover, in the first and second embodiments described above, the cloth of the roman shade has been taken up as an example of a shielding member; however, the shielding member may be a slat of a horizontal blind, a screen of a pleated screen, and the like.

Moreover, in the first and second embodiments described above, the first and second engaging sections engage the first and second engaged sections or are moved out of engagement with the first and second engaged sections as a result of the first and second engaging sections revolving to the outside or inside in the radial direction of the first and second input shafts. However, the first and second engaging sections may engage the first and second engaged sections or may be moved out of engagement with the first and second engaged sections as a result of the first and second engaging sections reciprocating outward or inward in the radial direction of the first and second input shafts. Furthermore, in the first and second embodiments described above, three first engaging sections, three second engaging sections, three first engaged sections, three second engaged sections, three first arm sections, three second arm sections, three first curved arm sections, and three second curved arm sections are provided; however, two, four, or five or more first engaging sections, second engaging sections, first engaged sections, second engaged sections, first arm sections, second arm sections, first curved arm sections, and second curved arm sections may be provided.

INDUSTRIAL APPLICABILITY

A solar radiation shielding apparatus of the present invention can be used to lift and lower a first shielding member and a second shielding member independently with operation of one operating cord.

EXPLANATIONS OF REFERENCE NUMERALS

10, 110 roman shade (solar radiation shielding apparatus)
11 first cloth (first shielding member)
12 second cloth (second shielding member)
13 head rail
14 operating cord
21, 121 first lifting and lowering unit
21*a* first input shaft
21*b* first output shaft
22, 122 second lifting and lowering unit
22*a* second input shaft
22*b* second output shaft
26, 126 pulley (rotating member)
31, 131 first clutch
31*a*, 131*a* first output drum
31*b*, 131*b* first engaging section
31*c*, 131*c* first cylindrical section
31*d*, 131*d* first engaged section
32, 132 second clutch
32*a*, 132*a* second output drum
32*b*, 132*b* second engaging section
32*c*, 132*c* second cylindrical section
32*d*, 132*d* second engaged section
41 first stopper
42 second stopper
50, 150 turning force transfer mechanism
61, 161 first clutch drum

62, 162 second clutch drum
71, 171 first cam
71*a*, 171*a* first arm section
72, 172 second cam
72*a*, 172*a* second arm section
81, 181 first resistance applying mechanism
82, 182 second resistance applying mechanism
91, 191 first return spring mechanism
92, 192 second return spring mechanism

The invention claimed is:

1. A solar radiation shielding apparatus comprising:

a head rail;

first and second shielding members hung from the head rail;

a first lifting and lowering unit provided in the head rail and connected to the first shielding member;

a second lifting and lowering unit provided in the head rail and connected to the second shielding member; and a single operating cord coupled to the first and second lifting and lowering units, the operating cord lifting and lowering the first and second shielding members independently by driving the first and second lifting and lowering units, wherein a rotating member is rotatably attached to the head rail, the operating cord is wound around the rotating member, the first lifting and lowering unit has a first input shaft rotatably attached to the head rail, the first input shaft to which a turning force of the rotating member is transferred without a turning force transfer mechanism or via the turning force transfer mechanism, a first output shaft rotatably attached to the head rail coaxially with the first input shaft, the first output shaft that can lift and lower the first shielding member, a first clutch provided between the first input shaft and the first output shaft, the first clutch transferring a turning force from the rotating member, the turning force in one direction, to the first output shaft via the first input shaft, the first clutch that does not transfer a turning force from the rotating member, the turning force in the other direction, to the first output shaft and does not transfer a turning force from the first output shaft to the first input shaft, and a first stopper provided in the first output shaft, the first stopper switching the first shielding member to a falling state or a stopped state with slight operation of the operating cord in one direction, and the second lifting and lowering unit has a second input shaft rotatably attached to the head rail, the second input shaft to which a turning force of the rotating member is transferred via a turning force transfer mechanism or without the turning force transfer mechanism a second output shaft rotatably attached to the head rail coaxially with the second input shaft, the second output shaft that can lift and lower the second shielding member, a second clutch provided between the second input shaft and the second output shaft, the second clutch transferring a turning force from the rotating member, the turning force in the other direction, to the second output shaft via the second input shaft, the second clutch that does not transfer a turning force from the rotating member, the turning force in one direction, to the second output shaft and does not transfer a turning force from the second output shaft to the second input shaft, and a second stopper provided in the second output shaft, the second stopper switching the second shielding member to a falling state or a stopped state with slight operation of the operating cord in the other direction, the first input shaft and the fist output shaft are oriented side-by-side in an axial direction of the first input shaft so as not to be positioned within each other in the axial direction of the first input shaft, and the second input shaft and the second output shaft are oriented side-by-side in an axial direction of the second input shaft so as not to be positioned within each other in the axial direction of the second input shaft.

2. The solar radiation shielding apparatus according to claim 1, wherein the first clutch has a first engaging section revolvable or reciprocatable in a radial direction of the first input shaft, and the first clutch transfers the turning force from the rotating member, the turning force in one direction, to the first output shaft via the first input shaft by the first engaging section and does not transfer the turning force from the rotating member, the turning force in the other direction, to the first output shaft and the turning force from the first output shaft to the first input shaft, and the second clutch has a second engaging section revolvable or reciprocatable in a radial direction of the second input shaft, and the second clutch transfers the turning force from the rotating member, the turning force in the other direction, to the second output shaft via the second input shaft by the second engaging section and does not transfer the turning force from the rotating member, the turning force in one direction, to the second output shaft and the turning force from the second output shaft to the second input shaft.

3. The solar radiation shielding apparatus according to claim 2, wherein as a result of the first engaging section rotating or moving to the outside in the radial direction of the first input shaft, the first output shaft engages the first input shaft and rotates in synchronization with the first input shaft, and, as a result of the first engaging section rotating or moving to the inside in the radial direction of the first input shaft, the first output shaft is moved out of engagement with the first input shaft and stops rotating in synchronization with the first input shaft, and as a result of the second engaging section rotating or moving to the outside in the radial direction of the second input shaft, the second output shaft engages the second input shaft and rotates in synchronization with the second input shaft, and, as a result of the second engaging section rotating or moving to the inside in the radial direction of the second input shaft, the second output shaft is moved out of engagement with the second input shaft and stops rotating in synchronization with the second input shaft.

4. The solar radiation shielding apparatus according to claim 1, wherein the first clutch has a first output drum non-rotatably attached to the first output shaft, the first output drum in which a first cylindrical section that is loosely fitted over the first input shaft is provided, the first cylindrical section having an inner circumferential surface in which a first engaged section is formed, a first clutch drum rotatably fitted over the first input shaft and located inside the first cylindrical section, a first cam non-rotatably fitted over the first input shaft and located inside the first cylindrical section, the first cam in which a first arm section extending to the outside in the radial direction of the first input shaft is formed, and the first engaging section revolvably attached to a side face of the first clutch drum, the first engaging section engaging the first engaged section by jutting to the outside in the radial direction of the first input shaft as a result of the first arm section of the first cam engaging the first engaging section upon rotation of the rotating member in one direction, the first engaging section that does not engage the first engaged section as a result of retracting to the inside in the radial direction of the fist input shaft at the time of rotation of the rotating member in the other direction or at the time of rotation of the first output shaft, and the second clutch has a second output drum non-rotatably attached to the second output shaft, the second output drum in which a second cylindrical section that is loosely fitted over the second input shaft is provided, the second cylindrical section having an inner circumferential surface in which a second engaged section is formed, a second clutch drum rotatably fitted over the second input shaft and located inside the second cylindrical section, a second cam non-rotatably fitted over the second input shaft and located inside the second cylindrical section, the second cam in which a second arm section extending to the outside in the radial direction of the second input shaft is formed, and the second engaging section revolvably attached to a side face of the second clutch drum, the second engaging section engaging the second engaged section by jutting to the outside in the radial direction of the second input shaft as a result of the second arm section of the second cam engaging the second engaging section upon rotation of the rotating member in the other direction, the second engaging section that does not engage the second engaged section as a result of retracting to the inside in the radial direction of the second input shaft upon rotation of the rotating member in one direction or upon rotation of the second output shaft.

5. The solar radiation shielding apparatus according to claim4, wherein an angle which a flat surface of the first engaged section, the flat surface at which the first engaged section makes contact with the first engaging section, forms with a flat surface making contact with an outer circumferential surface of the first cylindrical section in the first engaged section is set at an acute angle, and an angle which a flat surface of the second engaged section, the flat surface at which the second engaged section makes contact with the second engaging section, forms with a flat surface making contact with an outer circumferential surface of the second cylindrical section in the second engaged section is set at an acute angle.

6. The solar radiation shielding apparatus according to claim 4, wherein between the first input shaft and the first clutch drum, a first resistance applying mechanism preventing rotation of the first clutch drum relative to the first input shaft is provided, and between the second input shaft and the second clutch drum, a second resistance applying mechanism preventing rotation of the second clutch drum relative to the second input shaft is provided.

7. The solar radiation shielding apparatus according to claim 4, wherein a first return spring mechanism urging the first engaging section to cause the first engaging section to retract to the inside in the radial direction of the first input shaft, wherein the first return spring mechanism is provided in the first engaging section, and second return spring mechanism urging the second engaging section to cause the second engaging section to retract to the inside in the radial direction of the second input shaft, wherein the first return spring mechanism is provided in the second engaging section.

* * * * *

UNITED STATES PATENT AND TRADEMARK OFFICE

CERTIFICATE OF CORRECTION

PATENT NO. : 8,763,674 B2
APPLICATION NO. : 13/519147
DATED : July 1, 2014
INVENTOR(S) : K. Kataoka et al.

It is certified that error appears in the above-identified patent and that said Letters Patent is hereby corrected as shown below:

In the Claims

Column 29, line 51 (claim 1, line 41) please change "mechanism a" to -- mechanism, a --
Column 31, line 36 (claim 5, line 2) please change "claim4" to -- claim 4 --

Signed and Sealed this
Twenty-fourth Day of February, 2015

Michelle K. Lee

Michelle K. Lee
*Deputy Director of the United States Patent and Trademark Office*